US011231216B2

(12) United States Patent
Jung et al.

(10) Patent No.: US 11,231,216 B2
(45) Date of Patent: Jan. 25, 2022

(54) AIR CONDITIONER, CONTROL DEVICE THEREOF, AND METHOD OF CONTROLLING THE SAME

(71) Applicant: Samsung Electronics Co., Ltd, Gyeonggi-do (KR)

(72) Inventors: Dong-Il Jung, Suwon-si (KR); Chang-Yong Lee, Suwon-si (KR); Jeong Mun Yeom, Hwaseong-si (KR); Je-Jin Lee, Suwon-si (KR); Jae Hun Hur, Yongin-si (KR); Dong Hyun Goh, Suwon-si (KR); Kwang Il Nam, Suwon-si (KR); Hyeong Joon Seo, Suwon-si (KR); Dong Kue Lee, Pyeongtaek-si (KR); Suk Ho Lee, Suwon-si (KR); Byoung Guk Lim, Suwon-si (KR); Hong Seok Jun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 227 days.

(21) Appl. No.: 15/865,218

(22) Filed: Jan. 8, 2018

(65) Prior Publication Data

US 2018/0195783 A1 Jul. 12, 2018

(30) Foreign Application Priority Data

Jan. 10, 2017 (KR) ..... 10-2017-0003461

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/007* (2013.01);
(Continued)

(58) Field of Classification Search
CPC ..... F25B 49/02; F25B 13/00; F05D 2260/213
(Continued)

(56) References Cited

U.S. PATENT DOCUMENTS 9,459,033 B2 10/2016 Tamaki et al.
2011/0224833 A1 9/2011 Kim et al.
(Continued)

FOREIGN PATENT DOCUMENTS

CN 104776630 A 7/2015
EP 1691139 A2 * 8/2006 ..... F24F 11/30
(Continued)

OTHER PUBLICATIONS

International Search Report dated May 2, 2018 in connection with International Patent Application No. PCT/KR2018/000416.
(Continued)

*Primary Examiner* — Paul Alvare

(57) ABSTRACT

An air conditioner, a control device thereof, and a method of controlling the same are provided. The air conditioner includes a control device including a plurality of indoor unit operation changers, and an indoor unit connected to any one of the plurality of indoor unit operation changers, where at least one of the indoor unit and the control device determines an operation mode of each of the plurality of indoor unit operation changers respectively connected to a plurality of indoor units, detects an indoor unit operation changer at an operation mode corresponding to an operation of any one of the plurality of indoor units among the plurality of indoor unit operation changers, and determines an indoor unit operation changer connected to the indoor unit among the plurality of indoor unit operation changers on based on a result of detecting at least one of the indoor unit operation changers.

11 Claims, 28 Drawing Sheets

(52) U.S. Cl.
CPC ..... *F25B 2313/0231* (2013.01); *F25B 2313/0233* (2013.01); *F25B 2313/02741* (2013.01); *F25B 2313/02791* (2013.01)

(58) Field of Classification Search
USPC ..... 361/699; 165/218
See application file for complete search history.

(56) References Cited

U.S. PATENT DOCUMENTS

| | | | | |
|---|---|---|---|---|
| 2012/0022702 | A1* | 1/2012 | Jang | F24F 12/006 700/277 |
| 2013/0174594 | A1* | 7/2013 | Yamashita | F25B 13/00 62/179 |
| 2013/0227978 | A1* | 9/2013 | Kawai | F25B 49/02 62/160 |
| 2013/0305758 | A1* | 11/2013 | Matsui | F25B 13/00 62/129 |
| 2015/0000310 | A1* | 1/2015 | Lee | F25D 29/00 62/56 |
| 2015/0034293 | A1* | 2/2015 | Takayama | F25B 13/00 165/207 |
| 2016/0223240 | A1* | 8/2016 | Maeda | F24F 1/26 |
| 2016/0245539 | A1* | 8/2016 | Motomura | G05B 19/042 |
| 2016/0245540 | A1* | 8/2016 | Koge | F25B 43/00 |
| 2017/0198945 | A1* | 7/2017 | Azuma | F24F 11/89 |
| 2017/0268791 | A1* | 9/2017 | Luo | F25B 13/00 |

FOREIGN PATENT DOCUMENTS

| | | | |
|---|---|---|---|
| EP | 1746364 | A2 | 1/2007 |
| EP | 2522919 | A2 | 11/2012 |
| EP | 2549203 | A2 | 1/2013 |
| EP | 2833086 | A1 | 2/2015 |
| JP | 2015528092 | A | 9/2015 |
| KR | 1020060055223 | A | 5/2006 |
| KR | 1020060108026 | A | 10/2006 |
| KR | 1020080060760 | A | 7/2008 |

OTHER PUBLICATIONS

Supplementary European Search Report in connection with European Application No. 18739133.9 dated Dec. 12, 2019, 8 pages.
Communication pursuant to Article 94(3) EPC dated Sep. 10, 2021 in connection with European Patent Application No. 18 739 133.9, 8 pages.

* cited by examiner

FIG. 6

| TYPE OF INDOOR UNIT OPERATION CHANGER | IDENTIFIER |
|---|---|
| FIRST INDOOR UNIT OPERATION CHANGER | 1 |
| SECOND INDOOR UNIT OPERATION CHANGER | 2 |
| THIRD INDOOR UNIT OPERATION CHANGER | 3 |
| ⋮ | ⋮ |
| NTH INDOOR UNIT OPERATION CHANGER | N |

FIG. 7

| TYPE OF INDOOR UNIT | DETERMINED INDOOR UNIT OPERATION CHANGER |
|---|---|
| FIRST INDOOR UNIT | FIRST INDOOR UNIT OPERATION CHANGER |
| SECOND INDOOR UNIT | SECOND INDOOR UNIT OPERATION CHANGER |
| THIRD INDOOR UNIT | THIRD INDOOR UNIT OPERATION CHANGER |
| ⋮ | ⋮ |
| NTH INDOOR UNIT | NTH INDOOR UNIT OPERATION CHANGER |

FIG. 8

| TYPE OF INDOOR UNIT | DETERMINED INDOOR UNIT OPERATION CHANGER | |
|---|---|---|
| FIRST INDOOR UNIT | FIRST INDOOR UNIT OPERATION CHANGER | T31 |
| SECOND INDOOR UNIT | FIRST INDOOR UNIT OPERATION CHANGER | T32 |
| THIRD INDOOR UNIT | THIRD INDOOR UNIT OPERATION CHANGER | T33 |
| THIRD INDOOR UNIT | FOURTH INDOOR UNIT OPERATION CHANGER | T34 |
| ⋮ | ⋮ | |

FIG. 10

| | STEP | FIRST INDOOR UNIT OPERATION CHANGER | SECOND INDOOR UNIT OPERATION CHANGER | THIRD INDOOR UNIT OPERATION CHANGER | FOURTH INDOOR UNIT OPERATION CHANGER |
|---|---|---|---|---|---|
| T401 | FIRST STEP | COOLING (T411) | COOLING (T421) | HEATING (T431) | HEATING (T441) |
| T402 | SECOND STEP | COOLING (T412) | COOLING (T422) | HEATING (T432) | HEATING (T442) |
| T403 | THIRD STEP | COOLING (T413) | HEATING (T423) | COOLING (T433) | HEATING (T443) |

FIG. 13

| | STEP | FIRST INDOOR UNIT | | |
|---|---|---|---|---|
| | | OPERATION | RESULT OF COMPARISON | |
| T501 | SECOND STEP | COOLING (T511) | FIRST INDOOR UNIT OPERATION CHANGER<br>SECOND INDOOR UNIT OPERATION CHANGER | (T521) |
| T502 | THIRD STEP | COOLING (T512) | FIRST INDOOR UNIT OPERATION CHANGER<br>THIRD INDOOR UNIT OPERATION CHANGER | (T522) |

FIG. 16

| | | IDENTIFIER OR SEPARATOR | RESULTING VALUE | MODE |
|---|---|---|---|---|
| T601 | FIRST STEP | IDENTIFIER | ODD | COOLING MODE |
| | | | EVEN | HEATING MODE |
| T602 | SECOND STEP | IDENTIFIER | ODD | COOLING MODE |
| | | | EVEN | HEATING MODE |
| T603 | THIRD STEP | IDENTIFIER/2 | ODD | COOLING MODE |
| | | | EVEN | HEATING MODE |
| T604 | FOURTH STEP | IDENTIFIER/4 | ODD | COOLING MODE |
| | | | EVEN | HEATING MODE |
| T605 | FIFTH STEP | IDENTIFIER/8 | ODD | COOLING MODE |
| | | | EVEN | HEATING MODE |
| T606 | SIXTH STEP | IDENTIFIER/16 | ODD | COOLING MODE |
| | | | EVEN | HEATING MODE |
| T607 | SEVENTH STEP | IDENTIFIER/32 | ODD | COOLING MODE |
| | | | EVEN | HEATING MODE |
| T608 | EIGHTH STEP | IDENTIFIER/64 | ODD | COOLING MODE |
| | | | EVEN | HEATING MODE |
| T609 | NINTH STEP | IDENTIFIER | ODD | HEATING MODE |
| | | | EVEN | COOLING MODE |

FIG. 17

SECOND STEP

| IDENTIFIER | 1 | 2 | 3 | 4 | 5 | 6 | 7 | 8 | 9 | 10 | 11 | 12 | ····· | 63 | 64 | 65 | ····· | 128 |
|---|---|---|---|---|---|---|---|---|---|---|---|---|---|---|---|---|---|---|
| RESULTING VALUE | ODD | EVEN | ODD | EVEN | ODD | EVEN | ODD | EVEN | ODD | EVEN | ODD | EVEN | ····· | ODD | EVEN | ODD | ····· | EVEN |

FIG. 18

| INDOOR UNIT INDEX | SECOND STEP | SELECTED IDENTIFIER |
|---|---|---|
| FIRST INDOOR UNIT | COOLING | 1,3,5,7,⋯ |
| SECOND INDOOR UNIT | HEATING | 2,4,6,8,⋯ |
| ⋮ | ⋮ | ⋮ |
| SIXTY-THIRD INDOOR UNIT | COOLING | 1,3,5,7,⋯ |
| SIXTY-FOURTH INDOOR UNIT | HEATING | 2,4,6,8,⋯ |
| ⋮ | ⋮ | ⋮ |
| HUNDRED-TWENTY-EIGHTH INDOOR UNIT | HEATING | 2,4,6,8,⋯ |

FIG. 19

THIRD STEP

| IDENTIFIER | 1 | 2 | 3 | 4 | 5 | 6 | 7 | 8 | 9 | 10 | 11 | 12 | ····· | 63 | 64 | 65 | ····· | 128 |
|---|---|---|---|---|---|---|---|---|---|---|---|---|---|---|---|---|---|---|
| SEPARATOR | 0 | 1 | 1 | 2 | 2 | 3 | 3 | 4 | 4 | 5 | 5 | 6 | ····· | 31 | 32 | 32 | ····· | 64 |
| RESULTING VALUE | EVEN | ODD | ODD | EVEN | EVEN | ODD | ODD | EVEN | EVEN | ODD | ODD | EVEN | ····· | ODD | ODD | EVEN | ····· | EVEN |

FIG. 20

| INDOOR UNIT INDEX | SECOND STEP | SELECTED IDENTIFIER |
|---|---|---|
| FIRST INDOOR UNIT | HEATING | 1,5,9,… |
| SECOND INDOOR UNIT | COOLING | 2,6,10,… |
| ⋮ | ⋮ | ⋮ |
| SIXTY-THIRD INDOOR UNIT | COOLING | 3,7,11,… |
| SIXTY-FOURTH INDOOR UNIT | HEATING | 4,8,12,… |
| ⋮ | ⋮ | ⋮ |
| HUNDRED-TWENTY-EIGHTH INDOOR UNIT | HEATING | 4,8,12,… |

FIG. 21

NINTH STEP

| IDENTIFIER | 1 | 2 | 3 | 4 | 5 | 6 | 7 | 8 | 9 | 10 | 11 | 12 | ····· | 63 | 64 | 65 | ····· | 128 |
|---|---|---|---|---|---|---|---|---|---|---|---|---|---|---|---|---|---|---|
| RESULTING VALUE OF SECOND STEP | ODD | EVEN | ODD | EVEN | ODD | EVEN | ODD | EVEN | ODD | EVEN | ODD | EVEN | ····· | ODD | EVEN | ODD | ····· | EVEN |
| RESULTING VALUE OF THIRD STEP | EVEN | ODD | ODD | EVEN | EVEN | ODD | ODD | EVEN | EVEN | ODD | ODD | EVEN | ····· | ODD | EVEN | EVEN | ····· | EVEN |
| RESULTING VALUE OF FOURTH STEP | EVEN | EVEN | EVEN | ODD | ODD | ODD | ODD | EVEN | EVEN | EVEN | EVEN | ODD | ····· | ODD | EVEN | EVEN | ····· | EVEN |
| RESULTING VALUE OF FIFTH STEP | EVEN | EVEN | EVEN | EVEN | EVEN | EVEN | EVEN | ODD | ODD | ODD | ODD | ODD | ····· | ODD | EVEN | EVEN | ····· | EVEN |
| RESULTING VALUE OF SIXTH STEP | EVEN | EVEN | EVEN | EVEN | EVEN | EVEN | EVEN | EVEN | EVEN | EVEN | EVEN | EVEN | ····· | ODD | EVEN | EVEN | ····· | EVEN |
| RESULTING VALUE OF SEVENTH STEP | EVEN | EVEN | EVEN | EVEN | EVEN | EVEN | EVEN | EVEN | EVEN | EVEN | EVEN | EVEN | ····· | ODD | EVEN | EVEN | ····· | EVEN |
| RESULTING VALUE OF EIGHTH STEP | EVEN | EVEN | EVEN | EVEN | EVEN | EVEN | EVEN | EVEN | EVEN | EVEN | EVEN | EVEN | ····· | EVEN | ODD | ODD | ····· | EVEN |
| RESULTING VALUE OF NINTH STEP | ODD | EVEN | ODD | EVEN | ODD | EVEN | ODD | EVEN | ODD | EVEN | ODD | EVEN | ····· | ODD | EVEN | ODD | ····· | EVEN |

FIG. 22

| INDOOR UNIT INDEX | NINTH STEP | SELECTED IDENTIFIER |
|---|---|---|
| FIRST INDOOR UNIT | COOLING | 1 |
| SECOND INDOOR UNIT | HEATING | 2 |
| ⋮ | ⋮ | ⋮ |
| SIXTY-THIRD INDOOR UNIT | COOLING | 63 |
| SIXTY-FOURTH INDOOR UNIT | HEATING | 64 |
| ⋮ | ⋮ | ⋮ |
| HUNDRED-TWENTY-EIGHTH INDOOR UNIT | HEATING | 128 |

FIG. 23

| | | IDENTIFIER OR SEPARATOR | RESULTING VALUE | MODE |
|---|---|---|---|---|
| T901 | FIRST STEP | IDENTIFIER | ODD | HEATING MODE |
| | | | EVEN | COOLING MODE |
| T902 | SECOND STEP | IDENTIFIER | ODD | HEATING MODE |
| | | | EVEN | COOLING MODE |
| T903 | THIRD STEP | IDENTIFIER/2 | ODD | HEATING MODE |
| | | | EVEN | COOLING MODE |
| T904 | FOURTH STEP | IDENTIFIER/4 | ODD | HEATING MODE |
| | | | EVEN | COOLING MODE |
| T905 | FIFTH STEP | IDENTIFIER/8 | ODD | HEATING MODE |
| | | | EVEN | COOLING MODE |
| T906 | SIXTH STEP | IDENTIFIER/16 | ODD | HEATING MODE |
| | | | EVEN | COOLING MODE |
| T907 | SEVENTH STEP | IDENTIFIER/32 | ODD | HEATING MODE |
| | | | EVEN | COOLING MODE |
| T908 | EIGHTH STEP | IDENTIFIER/64 | ODD | HEATING MODE |
| | | | EVEN | COOLING MODE |
| T909 | NINTH STEP | IDENTIFIER | ODD | COOLING MODE |
| | | | EVEN | HEATING MODE |

FIG. 27

| | IDENTIFIER OR SEPARATOR | RESULTING VALUE | MODE |
|---|---|---|---|
| FIRST STEP | IDENTIFIER | REMAINDER IS 1 | COOLING MODE |
| | | REMAINDER IS 2 | HEATING MODE |
| | | REMAINDER IS 0 | BREAK MODE |
| SECOND STEP | IDENTIFIER | REMAINDER IS 1 | COOLING MODE |
| | | REMAINDER IS 2 | HEATING MODE |
| | | REMAINDER IS 0 | BREAK MODE |
| THIRD STEP | IDENTIFIER/3 | REMAINDER IS 1 | COOLING MODE |
| | | REMAINDER IS 2 | HEATING MODE |
| | | REMAINDER IS 0 | BREAK MODE |

FIG. 28

| | STEP | 1 | 2 | 3 | 4 | 5 | 6 | 7 | 8 | 9 |
|---|---|---|---|---|---|---|---|---|---|---|
| T401 | FIRST STEP | COOLING | HEATING | BREAK | COOLING | HEATING | BREAK | COOLING | HEATING | BREAK |
| T402 | SECOND STEP | COOLING | HEATING | BREAK | COOLING | HEATING | BREAK | COOLING | HEATING | BREAK |
| T403 | THIRD STEP | BREAK | BREAK | COOLING | COOLING | COOLING | HEATING | HEATING | HEATING | BREAK |

AIR CONDITIONER, CONTROL DEVICE THEREOF, AND METHOD OF CONTROLLING THE SAME

CROSS-REFERENCE TO RELATED APPLICATION

This application is related to and claims priority to Korean Patent Application No. 10-2017-0003461 filed on Jan. 10, 2017, the disclosure of which is incorporated herein by reference.

TECHNICAL FIELD

Embodiments of the present disclosure relate to an air conditioner, a control device thereof, and a method of controlling the same.

BACKGROUND

An air conditioner is an apparatus for adjusting indoor air to be suitable for a purpose of use and is an apparatus configured to adjust temperature, humidity, purity, flow, or the like of indoor air. The air conditioner may be used in various locations such as a general house, an office, a factory, and a vehicle.

Generally, an air conditioner may emit cooled air acquired through a cooling cycle that consists of a process of compressing, condensing, expanding, and evaporating a refrigerant to an indoor space or emit heated air acquired by performing the above-described process in a reverse order to an indoor space to adjust indoor air.

For example, an air conditioner may include a compressor, a condenser, an expansion valve, an evaporator, and a fan, and a refrigerant may sequentially pass through the compressor, the condenser, the expansion valve, and the evaporator to adjust indoor air.

An air conditioner may include a multi-air conditioner. The multi-air conditioner connects a plurality of indoor units to at least one outdoor unit via a single piping system to adjust air in a plurality of indoor spaces. In this case, all of indoor units installed in the indoor spaces may perform a cooling operation or a heating operation. Alternatively, some of the plurality of indoor units may perform the cooling operation, and the remaining indoor units may perform the heating operation.

SUMMARY

To address the above-discussed deficiencies, it is a primary object to provide an air conditioner, a control device thereof, and a method of controlling the same capable of promptly and accurately determining automatically how each of a plurality of indoor units is connected to the control device.

Additional aspects of the disclosure will be set forth in part in the description which follows and, in part, will be obvious from the description, or may be learned by practice of the disclosure.

To achieve the above aspect, there are provided an air conditioner, a control device thereof, and a method of controlling the same.

In accordance with one aspect of the present disclosure, an air conditioner includes a control device including a plurality of indoor unit operation changers configured to be set to a cooling mode or a heating mode, and an indoor unit connected to any one of the plurality of indoor unit operation changers and configured to perform a cooling operation or a heating operation according to a result of setting the plurality of indoor unit operation changers, wherein at least one of the indoor unit and the control device determines an operation mode of each of the plurality of indoor unit operation changers respectively connected to a plurality of indoor units, detects an indoor unit operation changer at an operation mode corresponding to an operation of any one of the plurality of indoor units among the plurality of indoor unit operation changers, and determines an indoor unit operation changer connected to the indoor unit among the plurality of indoor unit operation changers on the basis of a result of detecting at least one of the indoor unit operation changers.

At least one of the indoor unit and the control device may detect at least one of the indoor unit operation changers set to the cooling mode among the plurality of indoor unit operation changers when the indoor unit performs the cooling operation and may detect at least one of the indoor unit operation changers set to the heating mode among the plurality of indoor unit operation changers when the indoor unit performs the heating operation.

At least one of the indoor unit and the control device may select at least one first cooling mode indoor unit operation changer and at least one first heating mode indoor unit operation changer among the plurality of indoor unit operation changers.

At least one of the indoor unit and the control device may detect the at least one first cooling mode indoor unit operation changer when the indoor unit performs the cooling operation and may detect the at least one first heating mode indoor unit operation changer when the indoor unit performs the heating operation.

At least one of the indoor unit and the control device may select, among the plurality of indoor unit operation changers, at least one second cooling mode indoor unit operation changer and at least one second heating mode indoor unit operation changer that are different from the at least one first cooling mode indoor unit operation changer and the at least one first heating mode indoor unit operation changer, respectively.

At least one of the indoor unit and the control device may detect the at least one second cooling mode indoor unit operation changer when the indoor unit performs the cooling operation, detect the at least one second heating mode indoor unit operation changer when the indoor unit performs the heating operation, and combine results of detecting at least two of the first cooling mode indoor unit operation changer, the first heating mode indoor unit operation changer, the second cooling mode indoor unit operation changer, and the second heating mode indoor unit operation changer to determine the indoor unit operation changer connected to the indoor unit among the plurality of indoor unit operation changers.

Some of the plurality of indoor unit operation changers may be set to the cooling mode, and the remaining indoor unit operation changers may be set to the heating mode.

Each of the plurality of indoor unit operation changers may be set to the cooling mode or the heating mode on the basis of an identifier assigned to each of the plurality of indoor unit operation changers or a separator acquired on the basis of the identifier.

Among the plurality of indoor unit operation changers, an indoor unit operation changer having an identifier or a separator corresponding to a first set and an indoor unit operation changer having an identifier corresponding to a second set may operate differently from each other.

The identifier of each of the indoor unit operation changers may include a value assigned differently for each of the indoor unit operation changers, and the separator may include a value resulting from dividing the identifier by at least one positive integer.

Each of the indoor unit operation changers may include a branch duct connected to each of the indoor units and a changer configured to change an operation of each of the indoor units to any one of the cooling operation and the heating operation.

At least one of the indoor unit and the control device may detect in advance at least one of the branch ducts connected to the indoor unit among the branch ducts of the plurality of indoor unit operation changers.

At least one of the indoor unit and the control device may determine the number of repetitions of the operations of determining an operation mode of each of the indoor unit operation changers and detecting each of the indoor unit operation changers in response to the number of the branch ducts connected to the indoor units.

In accordance with another aspect of the present disclosure, a control device includes a plurality of branch ducts, a plurality of changers configured to change an operation of at least one indoor unit connected to at least one of the plurality of branch ducts to any one of a cooling operation and a heating operation, and a controller configured to detect at least one of the changers set to a cooling mode among the plurality of changers when the at least one indoor unit performs the cooling operation, detect at least one of the changers set to a heating mode among the plurality of changers when the at least one indoor unit performs the heating operation, and determine a changer corresponding to the at least one indoor unit among the plurality of changers on the basis of a result of detecting at least one of the changers.

In accordance with still another aspect of the present disclosure, a method of controlling an air conditioner includes determining an operation mode of each of a plurality of indoor unit operation changers connected to a plurality of indoor units, respectively, detecting an indoor unit operation changer at an operation mode corresponding to an operation of any one of the plurality of indoor units among the plurality of indoor unit operation changers, and determining an indoor unit operation changer connected to the indoor unit among the plurality of indoor unit operation changers on the basis of a result of detecting the indoor unit operation changer.

The detecting of the indoor unit operation changer at the operation mode corresponding to the operation of any one of the plurality of indoor units among the plurality of indoor unit operation changers may include at least one of detecting at least one indoor unit operation changer set to a cooling mode among the plurality of indoor unit operation changers when the indoor unit performs a cooling operation and detecting at least one indoor unit operation changer set to a heating mode among the plurality of indoor unit operation changers when the indoor unit performs a heating operation.

The detecting of the indoor unit operation changer at the operation mode corresponding to the operation of any one of the plurality of indoor units among the plurality of indoor unit operation changers may include selecting at least one first indoor unit operation changer to be set to the cooling mode among the plurality of indoor unit operation changers and detecting the at least one first indoor unit operation changer when the indoor unit performs the cooling operation and detecting a second indoor unit operation changer other than the at least one first indoor unit operation changer when the indoor unit performs the heating operation.

The detecting of the indoor unit operation changer at the operation mode corresponding to the operation of any one of the plurality of indoor units among the plurality of indoor unit operation changers may further include selecting, among the plurality of indoor unit operation changers, at least one third indoor unit operation changer to be set to the cooling mode that are different from the at least one first indoor unit operation changer, detecting the at least one third indoor unit operation changer when the indoor unit performs the cooling operation and detecting a fourth indoor unit operation changer other than the at least one third indoor unit operation changer when the indoor unit performs the heating operation, and combining results of detecting the first indoor unit operation changer, the second indoor unit operation changer, the third indoor unit operation changer, and the fourth indoor unit operation changer to determine an indoor unit operation changer connected to the indoor unit among the plurality of indoor unit operation changers.

The determining of the operation mode of each of the plurality of indoor unit operation changers connected to the plurality of indoor units, respectively, may include determining the operation mode of each of the plurality of indoor unit operation changers on the basis of an identifier assigned to each of the plurality of indoor unit operation changers or a separator acquired on the basis of the identifier.

The method of controlling an air conditioner may further include detecting in advance at least one branch duct connected to the indoor unit among a plurality of branch ducts and determining the number of repetitions of the operations of determining an operation mode of each of the indoor unit operation changers and detecting each of the indoor unit operation changers in response to the number of the branch ducts connected to the indoor units.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 6 is a view for describing an example of identifiers of indoor unit operation changers;

FIG. 7 is a view for describing an example of results of determining indoor units connected to the indoor unit operation changers;

FIG. 8 is a view for describing several examples of an error in a result of determining an indoor unit connected to an indoor unit operation changer;

FIG. 10 is a view illustrating an example of settings of indoor unit operation changers according to each step;

FIG. 13 is a view for describing an operation of a first indoor unit and an operation mode of an indoor unit operation changer in a plurality of steps;

FIG. 16 is a view for describing a process of setting an operation of an indoor unit operation changer in each step when 128 indoor units are installed in a control device according to an embodiment;

FIG. 17 is a view for describing a process of setting an operation of an indoor unit operation changer in a first step;

FIG. 18 is a view for describing an example of an indoor unit operation changer selected for each indoor unit in a second step;

FIG. 19 is a view for describing a process of setting an operation of an indoor unit operation changer in a third step;

FIG. 20 is a view for describing an example of an indoor unit operation changer selected for each indoor unit in the third step;

FIG. 21 is a view for describing a process of setting an operation of an indoor unit operation changer in each of the plurality of steps according to an embodiment;

FIG. 22 is a view for describing an example of an indoor unit operation changer selected for each indoor unit in each of the plurality of steps;

FIG. 23 is a view for describing a process of setting an operation of an indoor unit operation changer in each step when 128 indoor units are installed in a control device according to another embodiment;

FIG. 27 is a view for describing a process of setting an operation of an indoor unit operation changer in each step according to another embodiment; and FIG. 28 is a view for describing a process of setting an operation of an indoor unit operation changer in each of the plurality of steps according to another embodiment.

DETAILED DESCRIPTION

FIGS. 1 through 28, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, an air conditioner, a control device thereof, and a method of controlling the same will be described in detail through the present specification. However, not all elements of embodiments of the present disclosure are described herein, and general knowledge in the art to which the present disclosure pertains or content overlapping between the embodiments will be omitted.

Terms used herein to which the suffix "-er" or "-or" is added may be implemented with software or hardware. According to an embodiment, a plurality of elements referred to by terms to which the suffix "-er" or "-or" is added may be implemented with a single element, or a single element referred to by a term to which the suffix "-er" or "-or" is added may include a plurality of elements. Terms such as "first" and "second" are used to distinguish one part from another part and do not imply a sequential order unless particularly described otherwise.

When a certain part is described as "including" a certain element, this signifies that the certain part may also include other elements rather than excluding other elements unless particularly described otherwise. Throughout the specification, when a certain part is described as being "connected" to another part, this may include a case in which the certain part is indirectly connected to the other part as well as a case in which the certain part is directly connected to the other part, and the indirect connection includes connection through a wireless communication network.

A singular expression includes a plural expression unless context clearly indicates otherwise.

Hereinafter, an air conditioner according to various embodiments will be described with reference to FIGS. 1 to 4.

Figure 1:
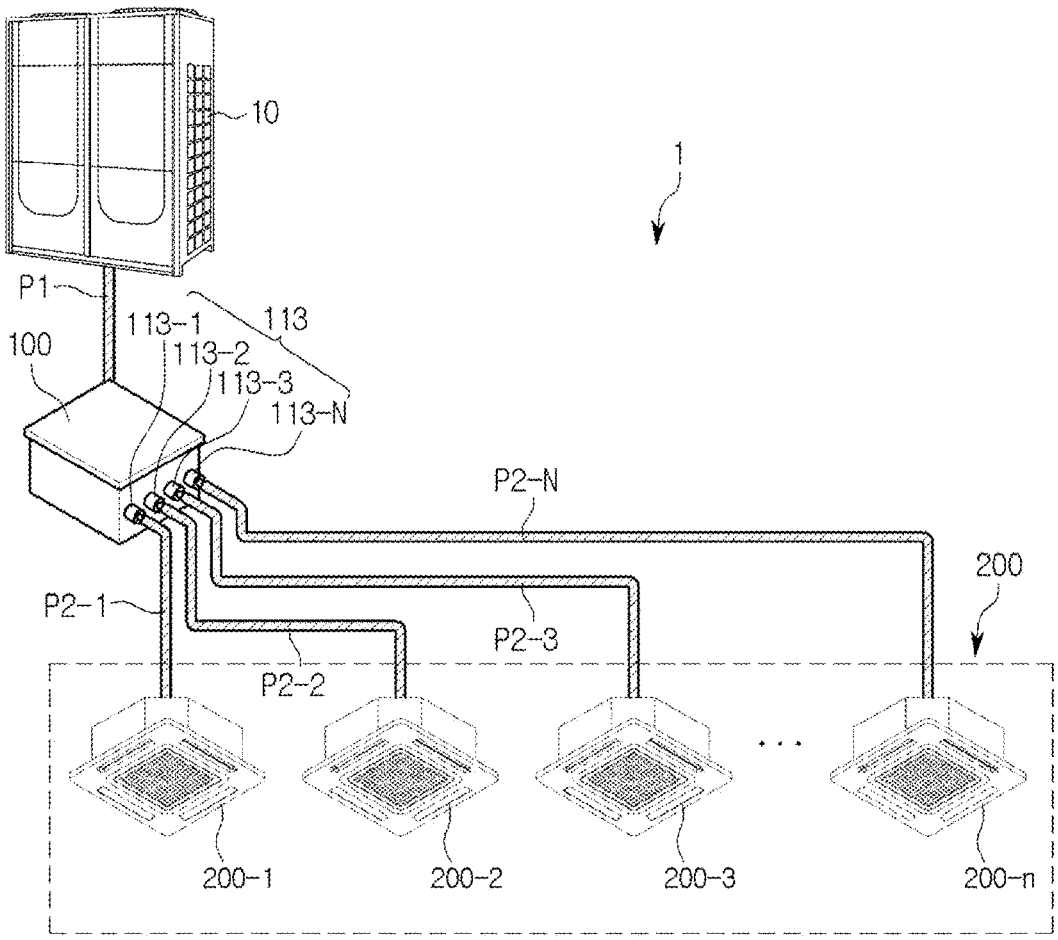
FIG. 1 is a schematic view of an air conditioner according to an embodiment.
Figure 2:
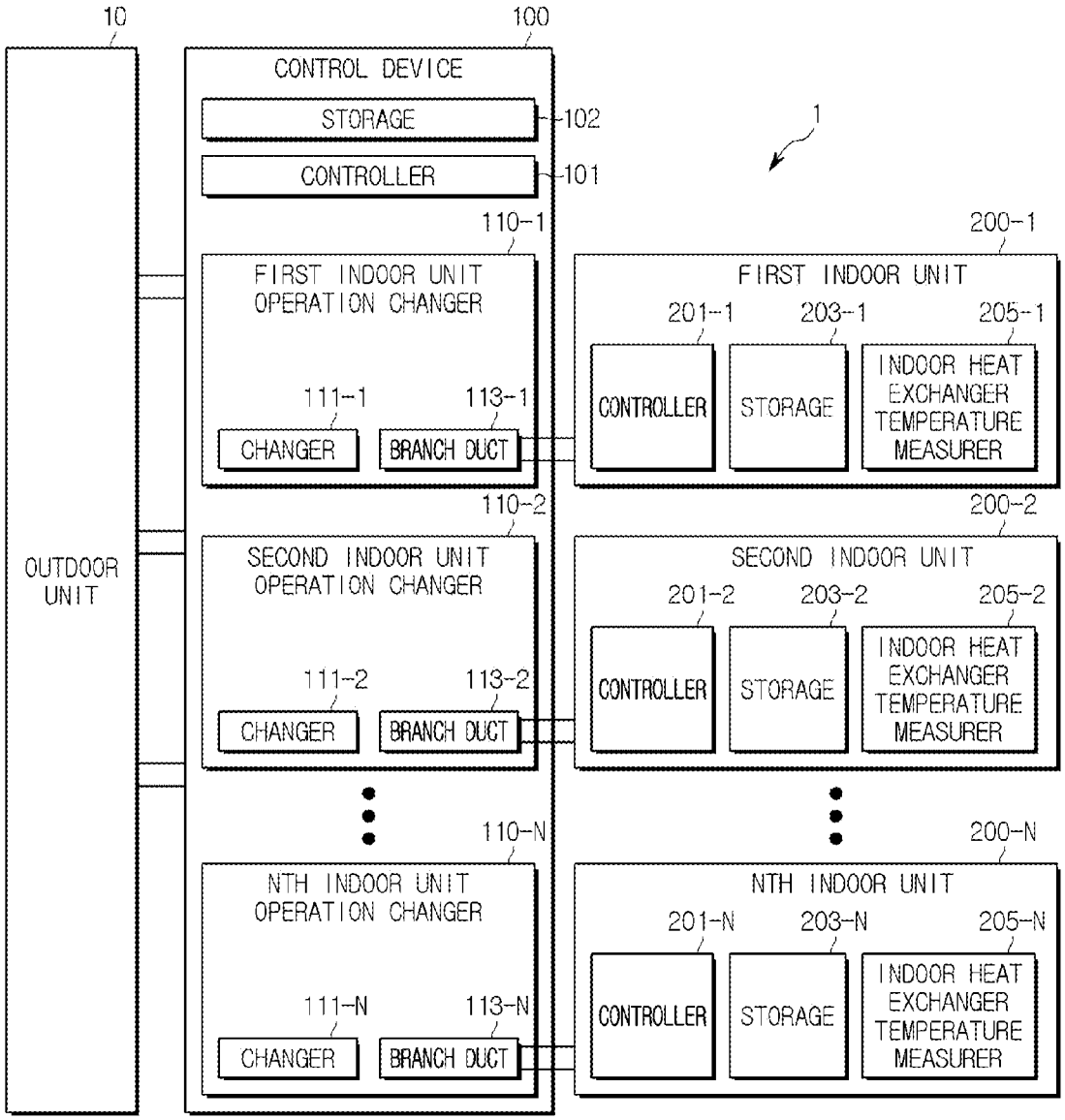
FIG. 2 is a block diagram of the air conditioner according to the embodiment.

FIG. 1 is a schematic view of an air conditioner according to an embodiment, and FIG. 2 is a block diagram of the air conditioner according to the embodiment As illustrated in FIGS. 1 and 2, an air conditioner 1 may include at least one outdoor unit 10, a control device 100 connected to the outdoor unit 10 via at least one pipe P1, and a plurality of indoor units 200 (200-1, 200-2, 200-3, . . . , 200-N) (hereinafter, N is a natural number greater than or equal to 1) connected to the control device 100 via a plurality of pipes P2-1, P2-2, P2-3, P2-N.

The air conditioner 1 may use a refrigerant flowing between the outdoor unit 10, the control device 100, and the plurality of indoor units 200 (200-1, 200-2, 200-3, . . . , 200-N) to provide cold air or hot air to an indoor space in which each of the indoor units 200 (200-1, 200-2, 200-3, . . . , 200-N) is installed.

A halogen compound refrigerant such as chlorofluorocarbon (CFC), a hydrocarbon refrigerant, carbon dioxide, ammonia, water, air, an azeotropic refrigerant, chloromethyl, or the like may be used as a refrigerant and, in addition, various other substances that may be taken into consideration by a designer may be used as the refrigerant.

The outdoor unit 10 is disposed at an outdoor space and performs a heat exchange between outdoor air and the refrigerant. The outdoor unit 10 may perform a cooling operation or a heating operation according to a predetermined setting or a user's selection.

Referring to FIG. 2, the outdoor unit 10 may be connected to the control device 100 via a plurality of pipes P11 to P13. Among the plurality of pipes P11 to P13, a first pipe P11 may be configured to guide a high-temperature refrigerant to the control device 100, a second pipe P12 may be configured to guide a refrigerant into which that heat is absorbed from the indoor units 200 (200-1, 200-2, 200-3, . . . , 200-N) to the outdoor unit 10, and a third pipe P13 may be configured to guide a refrigerant that emits heat to any one of the outdoor unit 10 and the indoor units 200 (200-1, 200-2, 200-3, . . . , 200-N) to the control device 100 or the outdoor unit 10.

The control device 100 is configured to transfer a refrigerant received from the outdoor unit 10 to at least one of the plurality of indoor units 200 (200-1, 200-2, 200-3, . . . , 200-N) or transfer a refrigerant received from at least one of the plurality of indoor units 200 (200-1, 200-2, 200-3, . . . , 200-N) to the outdoor unit 10.

The control device 100 may independently control the indoor units 200-1, 200-2, 200-3, . . . , 200-N so that some of the plurality of indoor units 200 (200-1, 200-2, 200-3, . . . , 200-N) perform the cooling operation and the remaining indoor units 200-1, 200-2, 200-3, . . . , 200-N perform the heating operation.

The control device 100 may also control the indoor units 200-1, 200-2, 200-3, . . . , 200-N so that all of the indoor units 200-1, 200-2, 200-3, . . . , 200-N perform the heating operation or all of the indoor units 200-1, 200-2, 200-3, . . . , 200-N perform the cooling operation.

The control device 100 may be implemented with a mode change unit (MCU) configured to control a change between a cooling mode and a heating mode.

As illustrated in FIG. 2, according to an embodiment, the control device 100 may include a controller 101, a storage 102, and one or more indoor unit operation changers 110 (110-1, 110-2, . . . , 110-N).

The controller 101 is configured to control overall operation that may be performed by the control device 100. The controller 101 may be implemented using a processor capable of performing various computations and control processes, such as a central processing unit (CPU), a microcomputer (MiCOM), and a micro control unit (MCU).

The controller 101 may generate a control signal according to a predetermined setting or a user's manipulation and independently transmit a generated control signal to each of the one or more indoor unit operation changers 110 (110-1, 110-2, . . . , 110-N) to control the one or more indoor unit operations changers 110 (110-1, 110-2, . . . , 110-N) to operate at the cooling mode or the heating mode.

Also, the controller 101 may determine the indoor units 200-1, 200-2, 200-3, . . . , 200-N respectively corresponding to the one or more indoor unit operation changers 110 (110-1, 110-2, . . . , 110-N). The controller 101 may transmit results of determining the indoor units 200-1, 200-2, 200-3, . . . , 200-N respectively corresponding to the one or more indoor unit operation changers 110 (110-1, 110-2, . . . , 110-N) to the storage 102 and control the storage 102 to store the results of determination.

The storage 102 may store various pieces of information required for the operations of the controller 101.

For example, the storage 102 may record various pieces of information, settings, and/or programs related to the operations of the controller 101 and provide the various pieces of information, the settings, and/or the programs to the controller 101 according to calls from the controller 101.

For example, the storage 102 may store an identifier related to each of the indoor unit operation changers 110 (110-1, 110-2, . . . , 110-N) or store information related to the indoor units 200-1, 200-2, 200-3, . . . , 200-N that perform the cooling operation at a particular time point or information related to the indoor units 200-1, 200-2, 200-3, . . . , 200-N that perform the heating operation at a particular time point. Also, the storage 102 may store various pieces of data or information required in the process of determining the indoor units 200-1, 200-2, 200-3, . . . , 200-N respectively corresponding to the indoor unit operation changers 110 (110-1, 110-2, . . . , 110-N). Furthermore, the storage 102 may store information on the indoor units 200-1, 200-2, 200-3, . . . , 200-N respectively corresponding to the indoor unit operation changers 110 (110-1, 110-2, . . . , 110-N) acquired according to control results of the controller 101.

The storage 102 may be implemented using a magnetic disk storage medium, a magnetic drum storage medium, or a semiconductor storage medium. For example, the semiconductor storage medium may include a volatile memory such as a static random access memory (S-RAM) and a dynamic RAM (D-RAM) or may include a nonvolatile memory such as a read only memory (ROM), an erasable programmable ROM (EPROM), an electrically EPROM (EEPROM), and a flash memory.

Each of the indoor unit operation changers 110 (110-1, 110-2, . . . , 110-N) may have at least one of the indoor units 200-1, 200-2, 200-3, . . . , 200-N connected thereto and may selectively connect at least one of the indoor units 200-1, 200-2, 200-3, . . . , 200-N connected thereto to any one of the first pipe P11 and the second pipe P12.

According to the embodiment, the indoor unit operation changers 110 (110-1, 110-2, . . . , 110-N) may include changers 111 (111-1, 111-2, . . . , 111-N) and branch ducts 113 (113-1, 113-2, . . . , 113-N). Although the branch ducts 113 (113-1, 113-2, . . . , 113-N) may be referred to as ports, the branch ducts 113 (113-1, 113-2, . . . , 113-N) will be uniformly referred to as branch ducts for convenience of description.

The changers 111 (111-1, 111-2, . . . , 111-N) may directly or indirectly connect the one or more indoor units 200 (200-1, 200-2, 200-3, . . . , 200-N) connected to corresponding branch ducts 113 (113-1, 113-2, . . . , 113-N) via the pipes P2-1, P2-2, P2-3, P2-N to any one of the first pipe P11 and the second pipe P12.

The changers 111 (111-1, 111-2, . . . , 111-N) may connect the one or more indoor units 200 (200-1, 200-2, 200-3, . . . , 200-N) to any one of the first pipe P11 and the second pipe P12 according to a set mode.

For example, when set to the heating mode, the changers 111 (111-1, 111-2, . . . , 111-N) may connect corresponding indoor units 200 (200-1, 200-2, 200-3, . . . , 200-N) to the first pipe P11 and allow the corresponding indoor units 200 (200-1, 200-2, 200-3, . . . , 200-N) to perform the heating operation.

As another example, when set to the cooling mode, the changers 111 (111-1, 111-2, . . . , 111-N) may connect corresponding indoor units 200 (200-1, 200-2, 200-3, . . . , 200-N) to the second pipe P12 and allow the corresponding indoor units 200 (200-1, 200-2, 200-3, . . . , 200-N) to perform the cooling operation.

The branch ducts 113 (113-1, 113-2, . . . , 113-N) are disposed to respectively correspond to the changers 111 (111-1, 111-2, . . . , 111-N). In other words, each of the branch ducts 113 (113-1, 113-2, . . . , 113-N) is connected to one of the changers 111 (111-1, 111-2, . . . , 111-N).

One ends of the pipes P2-1, P2-2, P2-3, P2-N may be respectively mounted at corresponding branch ducts 113 (113-1, 113-2, . . . , 113-N). The other ends of the pipes P2-1, P2-2, P2-3, P2-N may be respectively mounted at corresponding indoor units 200 (200-1, 200-2, 200-3, . . . , 200-N). Accordingly, each of the indoor units 200 (200-1, 200-2, 200-3, . . . , 200-N) is connected to any one of the plurality of branch ducts 113 (113-1, 113-2, . . . , 113-N) of the control device 100, and accordingly, the refrigerant flows between the branch ducts 113 (113-1, 113-2, . . . , 113-N) and the indoor units 200 (200-1, 200-2, 200-3, . . . , 200-N).

According to the embodiment, each of the branch duct 113 (113-1, 113-2, . . . , 113-N) may be connected to one of the pipes P2-1, P2-2, P2-3, P2-N of the indoor units 200 (200-1, 200-2, 200-3, . . . , 200-N). More specifically, as illustrated in FIGS. 1 and 2, a first branch duct 113-1 may be connected to the first pipe P11 of a first indoor unit 200-1, a second branch duct 113-2 may be connected to the second pipe P12 of a second indoor unit 200-2, and an $N^{th}$ branch duct 113-N may be connected to the third pipe P13 of an $N^{th}$ indoor unit 200-N.

Figure 3:
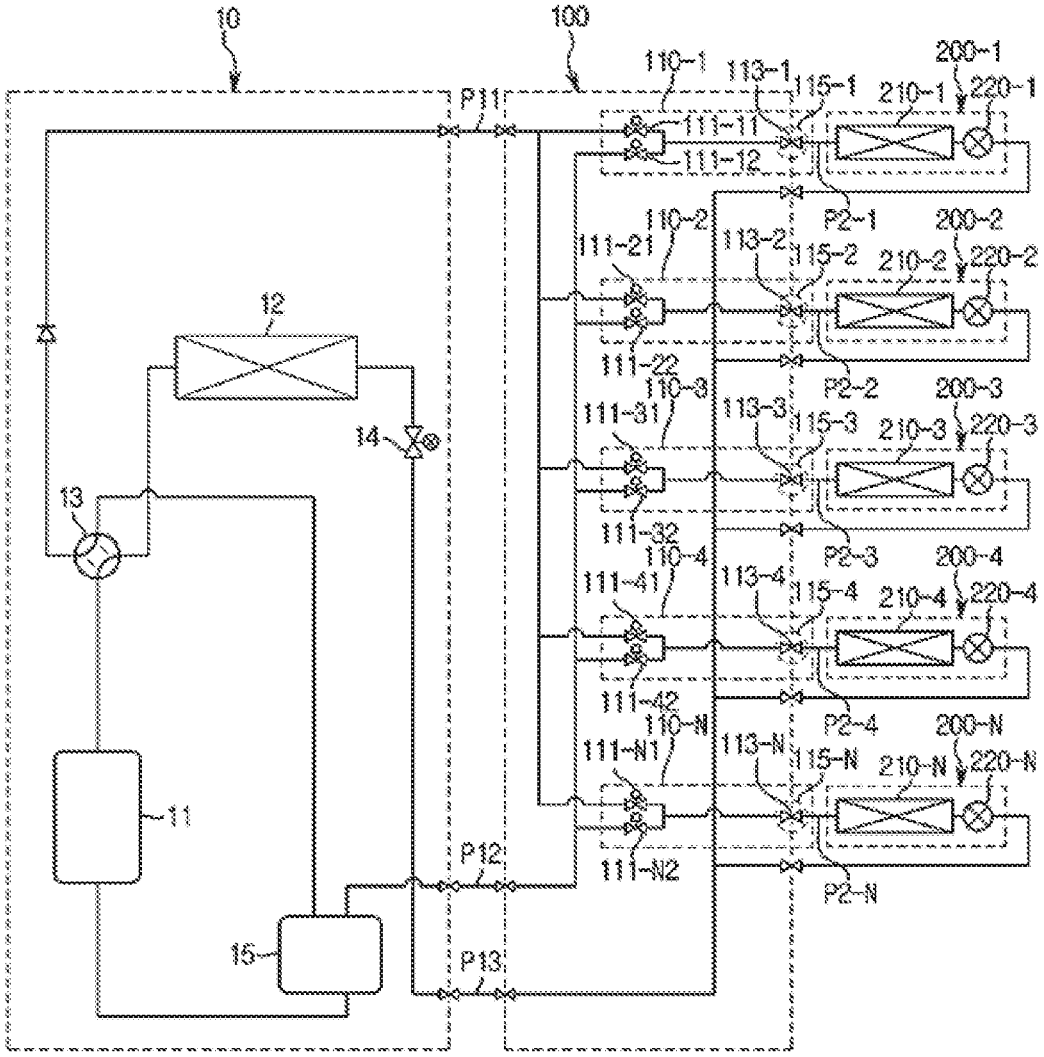
FIG. 3 is a schematic view of an air conditioner according to another embodiment.

FIG. 3 is a schematic view of an air conditioner according to another embodiment.

According to the other embodiment, each of the pipes P2-1, P2-2, P2-3, P2-N of the plurality of indoor units 200 (200-1, 200-2, 200-3, . . . , 200-N) may be mounted and connected to one of the branch ducts 113 (113-1, 113-2, . . . , 113-N).

For example, the first branch duct 113-1 may include a plurality of sub-branch ducts 113-11, 113-12, and 113-13. Each of the sub-branch ducts 113-11, 113-12, and 113-13 may be connected to different pipes P2-1, P2-2, P2-3, P2-N of the indoor units 200 (200-1, 200-2, 200-3, . . . , 200-N).

For example, as illustrated in FIG. 3, among the plurality of sub-branch ducts 113-11, 113-12, and 113-13, a first sub-branch duct 113-11 may be connected to the first pipe P11 of the first indoor unit 200-1, a second sub-branch duct 113-12 may be connected to the second pipe P12 of the second indoor unit 200-2, and a third sub-branch duct 113-13 may be connected to the third pipe P13 of a third indoor unit 200-3.

Accordingly, a plurality of indoor units, e.g., the first indoor unit 200-1, the second indoor unit 200-2, and the third indoor unit 200-3, may be connected to a single branch duct, e.g., the first branch duct 113-1.

When the plurality of indoor units 200 (200-1, 200-2, 200-3, . . . , 200-N) are connected to one of the branch ducts 113 (113-1, 113-2, . . . , 113-N), a plurality of indoor units, e.g., the first indoor unit 200-1, the second indoor unit 200-2, and the third indoor unit 200-3, may be connected to any one of the first pipe P11 and the second pipe P12 together according to an operation of any one of the indoor unit operation changers, e.g., a first indoor unit operation changer 110-1.

According to the embodiment, as illustrated in FIG. 3, when the first branch duct 113-1 includes the plurality of sub-branch ducts 113-11, 113-12, and 113-13, another branch duct, e.g., the second branch duct 113-2, may not include a sub-branch duct. For example, a single indoor unit 200-N may be connected to the second branch duct 113-2.

According to another embodiment, another branch duct, e.g., the second branch duct 113-2 may also include a plurality of sub-branch ducts (not illustrated).

The indoor units 200 (200-1, 200-2, 200-3, . . . , 200-N) may perform the heating operation to emit and provide hot air to an indoor space or perform the cooling operation to emit and provide cold air to the indoor space, thereby adjusting temperature of the indoor space.

As illustrated in FIGS. 1 to 3, the air conditioner 1 is connected to at least one of the plurality of branch ducts 113 (113-1, 113-2, 113-3, 113-N) via the pipes P2-1, P2-2, P2-3, and P2-N. Accordingly, the plurality of indoor units 200 (200-1, 200-2, 200-3, . . . , 200-N) may be connected to the control device 100 and perform the heating operation or the cooling operation according to an operation of the control device 100.

According to the embodiment, as illustrated in FIG. 2, the indoor units 200 (200-1, 200-2, 200-3, . . . , 200-N) may respectively include controllers 201-1, 201-2, . . . , 201-N and storages 203-1, 203-2, . . . , 203-N.

The controllers 201-1, 201-2, . . . , 201-N are configured to control overall operations of the indoor units 200 (200-1, 200-2, 200-3, . . . , 200-N). The controllers 201-1, 201-2, . . . , 201-N may be separately disposed for each of the indoor units 200 (200-1, 200-2, 200-3, . . . , 200-N).

According to the embodiment, the controllers 201-1, 201-2, . . . , 201-N may determine the indoor unit operation changers 110 (110-1, 110-2, . . . , 110-N) corresponding to the indoor units 200-1, 200-2, 200-3, . . . , 200-N. For this, the controllers 201-1, 201-2, . . . , 201-N may call a predetermined program stored in the storages 203-1, 203-2, and 203-N and operate the called program for the controllers 201-1, 201-2, . . . , 201-N to determine the indoor unit operation changers 110 (110-1, 110-2, . . . , 110-N) corresponding to the installed indoor units 200-1, 200-2, 200-3, . . . , 200-N.

The controllers 201-1, 201-2, . . . , 201-N may be implemented using a processor capable of performing various computations and control processes, such as a CPU, a MiCOM, and a MCU.

The storages 203-1, 203-2, . . . , 203-N may be configured to store various pieces of information, data, or programs required for operations of the controllers 201-1, 201-2, . . . , 201-N.

For example, the storages 203-1, 203-2, . . . , 203-N may store an identifier related to each of the indoor unit operation changers 110 (110-1, 110-2, . . . , 110-N), store various pieces of data or information required in the process of determining the indoor units 200-1, 200-2, 200-3, . . . , 200-N respectively corresponding to the indoor unit operation changers 110 (110-1, 110-2, . . . , 110-N), and/or store information on the indoor unit operation changers 110 (110-1, 110-2, . . . , 110-N) respectively corresponding to the indoor units 200-1, 200-2, 200-3, . . . , 200-N.

For example, the storages 203-1, 203-2, . . . , 203-N may be implemented using a magnetic disk storage medium, a magnetic drum storage medium, or a semiconductor storage medium.

According to the embodiment, the indoor units 200 (200-1, 200-2, 200-3, . . . , 200-N) may further include indoor heat exchanger temperature measurers 205-1, 205-2, . . . , 205-N.

The indoor heat exchanger temperature measurers 205-1, 205-2, . . . , 205-N may measure temperatures of indoor heat exchangers 210-1, 210-2, 210-3, 210-4, and 210-N (see FIG. 3) respectively disposed in the indoor units 200 (200-1, 200-2, 200-3, . . . , 200-N) or temperature of air around the indoor heat exchangers 210-1, 210-2, 210-3, 210-4, and 210-N.

The indoor heat exchanger temperature measurers 205-1, 205-2, . . . , 205-N may be separately installed for each of the indoor units 200 (200-1, 200-2, 200-3, . . . , 200-N).

The indoor heat exchanger temperature measurers 205-1, 205-2, . . . , 205-N are configured to communicate with the controller 101 of the control device 100 or the respective controllers 201-1, 201-2, . . . , 201-N of the indoor units 200 (200-1, 200-2, 200-3, . . . , 200-N) using at least one of a wired network and a wireless network. The temperatures of the indoor heat exchangers 210-1, 210-2, 210-3, 210-4, and 210-N or the temperature of air around the indoor heat exchangers 210-1, 210-2, 210-3, 210-4, and 210-N measured by the indoor heat exchanger temperature measurers 205-1, 205-2, . . . , 205-N may be transmitted in the form of an electrical signal to the controller 101 of the control device 100 or the respective controllers 201-1, 201-2, . . . , 201-N of the indoor units 200 (200-1, 200-2, 200-3, . . . , 200-N) using at least one of the wired network and the wireless network.

Depending on embodiments, the indoor units 200 (200-1, 200-2, 200-3, . . . , 200-N) may include a ceiling-mounted indoor unit, a wall-mounted indoor unit, or a floor-standing indoor unit.

Hereinafter, a process in which the air conditioner 1 operates will be described in more detail with reference to FIG. 4.

Figure 4:
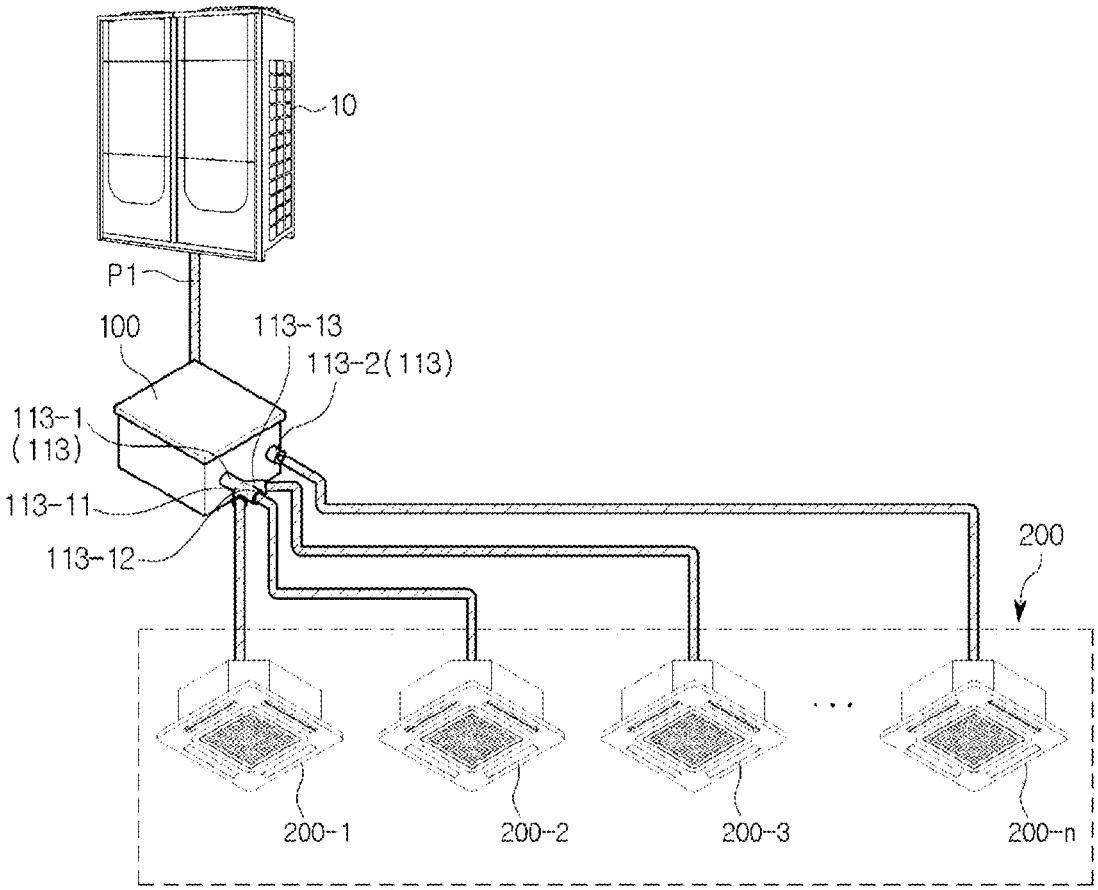
FIG. 4 is a view for describing an operation of the air conditioner according to the embodiment.

FIG. 4 is a view for describing an operation of the air conditioner according to the embodiment.

Referring to FIG. 4, as described above, the air conditioner 1 may include at least one outdoor unit 10, one or more indoor units 200-1, 200-2, 200-3, 200-4, . . . , 200-N, and the control device 100 configured to connect the at least one outdoor unit 10 to the one or more indoor units 200-1, 200-2, 200-3, 200-4, . . . , 200-N.

The outdoor unit 10 may include at least one compressor 11 configured to compress a refrigerant, an outdoor heat exchanger 12 configured to perform a heat exchange between outdoor air and the refrigerant, and an expansion valve 14 configured to decompress a refrigerant transferred to the indoor units 200-1, 200-2, 200-3, 200-4, . . . , 200-N during the cooling operation and decompress a refrigerant transferred to the outdoor heat exchanger 12 during the heating operation.

The outdoor unit 10 may further include a four-way valve 13 configured to selectively guide the refrigerant discharged from the compressor 11.

The four-way valve 13 may connect any two of four outlets to each other and connect the other two outlets to determine a direction in which the refrigerant flows. The four-way valve 13 may guide the refrigerant discharged from the compressor 11 toward the first pipe P11 or toward the outdoor heat exchanger 12 depending on operations and allow the outdoor unit 10 to perform the heating operation or the cooling operations.

According to the embodiment, the four-way valve 13 may be configured to change the direction in which the refrigerant flows according to a predetermined pattern. For example, the four-way valve 13 may periodically change the direction in which the refrigerant flows. According to another embodiment, the four-way valve 13 may be configured to arbitrarily change the direction in which the refrigerant flows.

As necessary, the outdoor unit 10 may further include an accumulator 15 to prevent introduction of a liquid refrigerant into the compressor 11. The accumulator 15 may separate an unevaporated liquid refrigerant and an evaporated gaseous refrigerant from each other and then provide the gaseous refrigerant to the compressor 11.

As described above, the control device 100 may include one or more indoor unit operation changers 110-1, 110-2, 110-3, 110-4, and 110-N connected in parallel to each other.

The one or more indoor unit operation changers 110-1, 110-2, 110-3, 110-4, and 110-N may respectively include the changers 111-1, 111-2, 111-3, 111-4, and 111-N.

For example, any one of the changers, e.g., a first changer 111-1, may include two valves 111-11 and 111-12.

According to the embodiment, the two valves 111-11 and 111-12 may be solenoid valves.

A first valve 111-11 of the two valves 111-11 and 111-12 is connected to the first pipe P11 and opens a flow path when set to the heating mode to connect first pipe P11 to the corresponding indoor unit, i.e., the first indoor unit 200-1. When at the cooling mode, the first valve 111-11 closes the flow path to block connection between the first indoor unit 200-1 and the first pipe P11.

A second valve 111-12 of the two valves 111-11 and 111-12 is connected to the second pipe P12 and opens a flow path when set to the cooling operation to connect the second pipe P12 to the first indoor unit 200-1 corresponding thereto. When set to the heating mode, the second valve 111-12 closes the flow path to block connection between the first indoor unit 200-1 and the second pipe P12.

The two valves 111-11 and 111-12 may open and close the flow path in reverse manner according to a set mode of the first changer 111-1 to control the first indoor unit 200-1 to perform the heating operation or the cooling operation.

Specifically, when the first valve 111-11 opens the flow path and the second valve 111-12 closes the flow path, the refrigerant discharged from the compressor 11 and guided via the first pipe P11 may be transferred to the first indoor unit 200-1, and accordingly, the first indoor unit 200-1 performs the heating operation.

Conversely, when the first valve 111-11 closes the flow path and the second valve 111-12 opens the flow path, the refrigerant discharged from the expansion valve 14 and guided via the third pipe P13 is transferred to the first indoor unit 200-1, and accordingly, the first indoor unit 200-1 performs the cooling operation. In this case, the refrigerant discharged from the first indoor unit 200-1 is transferred to the compressor 11 or the accumulator 15 via the flow path opened by the second valve 111-12 and the second pipe P12.

Although the operation of the first changer 111-1 among the plurality of changers 111-1, 111-2, 111-3, 111-4, . . . , 111-N has been described above, the changers 111-2, 111-3, 111-4, . . . , 111-N other than the first changer 111-1 may also include two valves 111-21 and 111-22, 111-31 and 111-32, 111-41 and 111-42, and 111-N1 and 111-N2, respectively. As described above, the two valves 111-21 and 111-22, 111-31 and 111-32, 111-41 and 111-42, or 111-N1 and 111-N2 may open and close the flow path according to whether the changers 111-2, 111-3, 111-4, . . . , 111-N are set to the heating mode or the cooling mode and allow the indoor units 200-2, 200-3, 200-4, . . . , 200-N respectively corresponding to the changers 111-2, 111-3, 111-4, . . . , 111-N to perform the cooling operation or the heating operation.

As described above, the one or more indoor unit operation changers 110-1, 110-2, 110-3, 110-4, and 110-N may respectively include the branch ducts 113-1, 113-2, 113-3, 113-4, . . . , 113-N at which the pipes P2-1, P2-2, P2-3, P2-4, P2-N are respectively installed.

The indoor units 200-1, 200-2, 200-3, 200-4, . . . , 200-N respectively corresponding to the branch ducts 113-1, 113-2, 113-3, 113-4, . . . , 113-N may be installed at the branch ducts 113-1, 113-2, 113-3, 113-4, . . . , 113-N.

As necessary, predetermined valves 115-1, 115-2, 115-3, 115-4, . . . , 115-N may be further installed at the branch ducts 113-1, 113-2, 113-3, 113-4, . . . , 113-N. The predetermined valves 115-1, 115-2, 115-3, 115-4, . . . , 115-N block transfer of the refrigerant discharged from the changers 111-1, 111-2, 111-3, 111-4, . . . , 111-N to the indoor units 200-1, 200-2, 200-3, 200-4, . . . , 200-N.

As illustrated in FIG. 3, the indoor units 200 (200-1, 200-2, 200-3, 200-4, . . . , 200-N) may include the indoor heat exchangers 210 (210-1, 210-2, 210-3, 210-4, . . . , 210-N) configured to perform a heat exchange between indoor air and a refrigerant.

The indoor heat exchangers 210 (210-1, 210-2, 210-3, 210-4, . . . , 210-N) absorb heat and are cooled when the indoor units 200-1, 200-2, 200-3, 200-4, . . . , 200-N perform the cooling operation and emit heat to the outside when the indoor units 200-1, 200-2, 200-3, 200-4, . . . , 200-N perform the heating operation. Accordingly, the indoor units 200-1, 200-2, 200-3, 200-4, . . . , 200-N may perform any one of the cooling operation and the heating operation.

The indoor units 200-1, 200-2, 200-3, 200-4, . . . , 200-N may further include indoor expansion valves 220 (220-1, 220-2, 220-3, 220-4, . . . , 220-N) configured to decompress a refrigerant provided to the indoor heat exchangers 210 during the cooling operation.

Hereinafter, refrigerant flows in the case in which the indoor units 200 (200-1, 200-2, 200-3, 200-4, . . . , 200-N) perform the cooling operation and the case in which the indoor units 200 (200-1, 200-2, 200-3, 200-4, . . . , 200-N) perform the heating operation will be described.

When the outdoor unit 10 performs the cooling operation and, accordingly, at least one of the plurality of indoor units 200 (200-1, 200-2, 200-3, 200-4, . . . , 200-N) performs the cooling operation, a refrigerant is compressed with a high pressure by the compressor 11 of the outdoor unit 10, and the compressed refrigerant flows to the outdoor heat exchanger 12 by the four-way valve 13. The compressed refrigerant is condensed in the outdoor heat exchanger 12 and emits latent heat. The condensed refrigerant is expanded through the expansion valve 14.

The expanded refrigerant is guided to the indoor units 200-1, 200-2, 200-3, 200-4, . . . , 200-N performing the cooling operation via the control device 100.

The refrigerant guided to the indoor units 200-1, 200-2, 200-3, 200-4, . . . , 200-N is decompressed in the indoor expansion valves 220-1, 220-2, 220-3, 220-4, . . . , 220-N disposed in the indoor units 200-1, 200-2, 200-3, 200-4, . . . , 200-N and then evaporated in the indoor heat exchangers 210-1, 210-2, 210-3, 210-4, . . . , 210-N. While the refrigerant is being evaporated, the refrigerant absorbs latent heat from indoor air and, accordingly, the indoor heat exchangers 210-1, 210-2, 210-3, 210-4, and 210-N or air around the indoor heat exchangers 210-1, 210-2, 210-3, 210-4, and 210-N are cooled.

The indoor heat exchangers 210-1, 210-2, 210-3, 210-4, and 210-N discharge the refrigerant into which latent heat is absorbed, and the discharged refrigerant is guided to the outdoor unit 10 via flow paths opened by the second valves 111-12, 111-22, 111-32, 111-42, . . . , 111-N2 of the control device 100 and the second pipe P12.

Depending on embodiments, the refrigerant is transferred to the compressor 11 via the accumulator 15, compressed by the compressor 11, and then transferred again to the four-way valve 13.

When the outdoor unit 10 performs the heating operation and, accordingly, at least one of the plurality of indoor units 200 (200-1, 200-2, 200-3, 200-4, . . . , 200-N) performs the heating operation, a refrigerant is compressed with a high pressure by the compressor 11 of the outdoor unit 10, and the compressed refrigerant flows to the first pipe P11 by the four-way valve 13.

The compressed refrigerant passes through flow paths opened by the first valves 111-11, 111-21, 111-31, 111-41, . . . , 111-N1 of the control device 100 and is guided to the indoor units 200-1, 200-2, 200-3, 200-4, . . . , 200-N performing the heating operation among the plurality of indoor units 200-1, 200-2, 200-3, 200-4, . . . , 200-N.

The refrigerant is condensed in the indoor heat exchangers 210-1, 210-2, 210-3, 210-4, . . . , 210-N disposed in the indoor units 200-1, 200-2, 200-3, 200-4, . . . , 200-N. While the refrigerant is being condensed, the refrigerant emits latent heat and, accordingly, the indoor heat exchangers 210-1, 210-2, 210-3, 210-4, and 210-N or air around the indoor heat exchangers 210-1, 210-2, 210-3, 210-4, and 210-N are heated.

The condensed refrigerant is decompressed in the indoor expansion valves 220-1, 220-2, 220-3, 220-4, . . . , 220-N and then flows to the outdoor unit 10 via the control device 100 and the third pipe P13.

The refrigerant transferred to the outdoor unit 10 is decompressed in an outdoor expansion valve 14, absorbs latent heat from the outdoor heat exchanger 12, and is transferred to the accumulator 15 or the compressor 11.

The accumulator 15 separates an unevaporated liquid refrigerant and an evaporated gaseous refrigerant from each other and transfers the gaseous refrigerant to the compressor 11.

The compressor 11 compresses the refrigerant provided from the outdoor heat exchanger 12 or the accumulator 15 and transfers the compressed refrigerant back to the four-way valve 13.

Through the above-described process, the air conditioner 1 may heat or cool a plurality of indoor spaces. In this case, the air conditioner 1 may selectively heat or cool one or more indoor spaces in which the one or more indoor units 200-1, 200-2, 200-3, 200-4, . . . , 200-N are respectively installed. More specifically, the one or more indoor units 200-1, 200-2, 200-3, 200-4, . . . , 200-N may independently perform the cooling operation or the heating operation depending on the operations of the one or more indoor unit operation changers 110-1, 110-2, 110-3, 110-4, . . . , 110-N, and accordingly, the air conditioner 1 may heat some of the plurality of indoor spaces and cool the remaining indoor spaces.

For the one or more indoor units 200-1, 200-2, 200-3, 200-4, . . . , 200-N respectively corresponding to the one or more indoor unit operation changers 110-1, 110-2, 110-3, 110-4, . . . , 110-N to perform a requested operation depending on the operations of the one or more indoor unit operation changers 110-1, 110-2, 110-3, 110-4, . . . , 110-N, the one or more indoor units 200-1, 200-2, 200-3, 200-4, . . . , 200-N respectively corresponding to the one or more indoor unit operation changers 110-1, 110-2, 110-3, 110-4, . . . , 110-N should be properly set.

The air conditioner 1 may also set the one or more indoor units 200-1, 200-2, 200-3, 200-4, . . . , 200-N respectively corresponding to the one or more indoor unit operation changers 110-1, 110-2, 110-3, 110-4, . . . , 110-N according to a user's manipulation.

As will be described below, the air conditioner 1 may also automatically determine and set the one or more indoor units 200-1, 200-2, 200-3, 200-4, . . . , 200-N respectively corresponding to the one or more indoor unit operation changers 110-1, 110-2, 110-3, 110-4, . . . , 110-N.

Hereinafter, various embodiments of a method of controlling an air conditioner will be described with reference to FIGS. 5 to 28.

Figure 5:
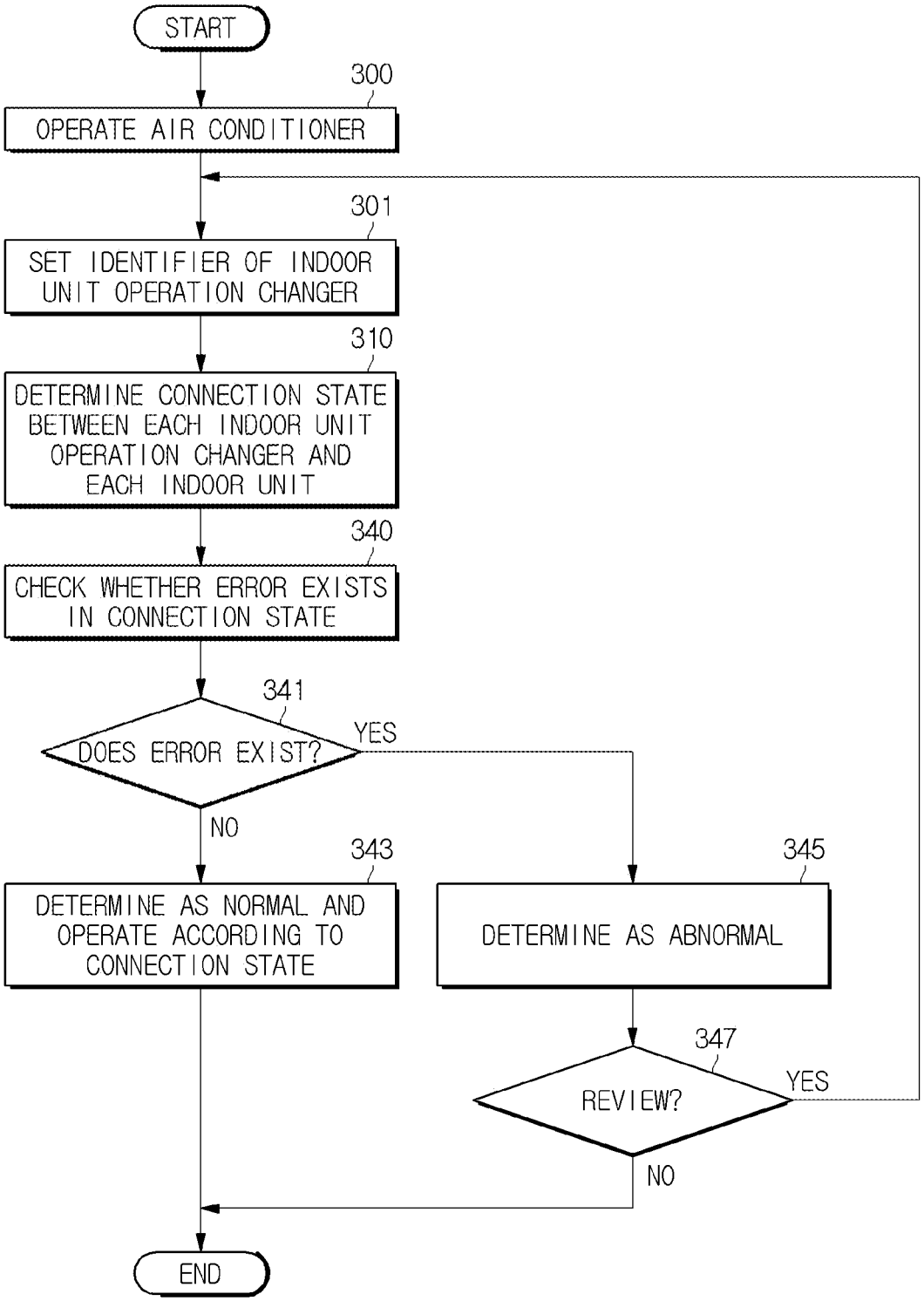
FIG. 5 is a flowchart of a method of controlling an air conditioner according to an embodiment.

FIG. 5 is a flowchart of a method of controlling an air conditioner according to an embodiment, and FIG. 6 is a view for describing an example of identifiers of indoor unit operation changers.

According to the embodiment illustrated in FIG. 5, first, an air conditioner starts operating according to a user's manipulation or a predetermined setting (300). In this case, power is supplied to the outdoor unit 10, the control device 100, and at least one of the plurality of indoor units 200 (200-1, 200-2, 200-3, . . . , 200-N).

The outdoor unit 10 performs the heating operation or the cooling operation depending on embodiments. For example, the outdoor unit 10 may perform the heating operation when outdoor temperature satisfies a heating operation condition, and the outdoor unit 10 may perform the cooling operation when the outdoor temperature does not satisfy the heating operation condition.

After the air conditioner starts operating, when determining a connection state between the one or more indoor unit operation changers 110-1, 110-2, 110-3, 110-4, and 110-N and the one or more indoor units 200-1, 200-2, 200-3, 200-4, . . . , 200-N begins, in response to this, an identifier for each of the indoor unit operation changers 110 (110-1, 110-2, . . . , 110-N) of the control device 100 may be set (301).

Here, the identifier for each of the indoor unit operation changers 110 (110-1, 110-2, . . . , 110-N) is for distinguishing each of the indoor unit operation changers 110 (110-1, 110-2, . . . , 110-N). For example, the identifier may be implemented using at least one of a letter, a number, a symbol, and a figure. The identifier for each of the indoor unit operation changers 110 (110-1, 110-2, . . . , 110-N) may be referred to by an address.

For example, as illustrated in FIG. 6, the identifier for each of the indoor unit operation changers 110 (110-1, 110-2, . . . , 110-N) may be defined with a number corresponding to each of the indoor unit operation changers 110 (110-1, 110-2, . . . , 110-N). More specifically, for example, the identifier for each of the indoor unit operation changers 110 (110-1, 110-2, . . . , 110-N) may include a number in the range of 1 to N sequentially assigned to each of the indoor unit operation changers 110 (110-1, 110-2, . . . , 110-N).

A table illustrated in FIG. 6 may be pre-stored in the storage 102 of the control device 100 or the respective storages 203 (203-1, 203-2, 203-3, . . . , 203-N) of the indoor units 200 (200-1, 200-2, 200-3, . . . , 200-N) or may be arbitrarily determined by the controller 101 of the control device 100 or the respective controllers 201 (201-1, 201-2, 201-3, . . . , 201-N) of the indoor units 200 (200-1, 200-2, 200-3, 200-4, . . . , 200-N).

Although an example in which an integer in the range of 1 to N is sequentially assigned to each of the first indoor unit operation changer 110-1 to the $N^{th}$ indoor unit operation changer 110-N is illustrated in the table illustrated in FIG. 6, this is merely illustrative. The integer in the range of 1 to N may also be assigned to each of the first indoor unit operation changer 110-1 to the $N^{th}$ indoor unit operation changer 110-N with a method different from the above according to a designer's arbitrary selection.

FIG. 7 is a view for describing an example of results of determining indoor units connected to the indoor unit operation changers.

When the identifier for each of the indoor unit operation changers 110 (110-1, 110-2, . . . , 110-N) is set (301), the connection state between each of the indoor unit operation changers 110 (110-1, 110-2, . . . , 110-N) and each of the indoor units 200 (200-1, 200-2, 200-3, . . . , 200-N) is determined (310).

Specifically, it is determined that the first indoor unit 200-1 is connected to the first indoor unit operation changer 110-1, or it is determined that the second indoor unit 200-2 is connected to the second indoor unit operation changer 110-2.

Accordingly, as illustrated in FIG. 7, results of determining the indoor units 200 (200-1, 200-2, 200-3, . . . , 200-N) respectively corresponding to the indoor unit operation changers 110 (110-1, 110-2, . . . , 110-N) or the indoor unit operation changers 110 (110-1, 110-2, . . . , 110-N) respectively corresponding to the indoor units 200 (200-1, 200-2, 200-3, . . . , 200-N) are acquired.

The acquired results of determination may be stored in the storage 102 of the control device 100 or the respective storages 203 (203-1, 203-2, 203-3, . . . , 203-N) of the indoor units 200 (200-1, 200-2, 200-3, . . . , 200-N).

A method of determining the connection state between each of the indoor unit operation changers 110 (110-1, 110-2, . . . , 110-N) and each of the indoor units 200 (200-1, 200-2, 200-3, . . . , 200-N) will be described below.

FIG. 8 is a view for describing several examples of an error in a result of determining an indoor unit connected to an indoor unit operation changer.

When the connection state between each of the indoor unit operation changers 110 (110-1, 110-2, . . . , 110-N) and each of the indoor units 200 (200-1, 200-2, 200-3, . . . , 200-N) is determined (310), whether an error exists in the connection state is determined (340, 341).

For example, when each of the indoor units 200 (200-1, 200-2, 200-3, . . . , 200-N) may be connected to one of the branch ducts 113 (113-1, 113-2, 113-3, . . . , 113-N) as illustrated in FIG. 1, a different indoor unit 200 (200-1, 200-2, 200-3, . . . , 200-N) should correspond to each of the branch ducts 113 (113-1, 113-2, 113-3, . . . , 113-N). When a result of determination indicates that a plurality of indoor units, i.e., the first indoor unit 200-1 and the second indoor unit 200-2, are connected to a single indoor unit operation changer, i.e., the first indoor unit operation changer 110-1, as indicated in rows T31 and T32 of FIG. 8, because this is contradictory to FIG. 1, the air conditioner 1 may determine that an error exists in the result of determination and that a state of the air conditioner 1 is abnormal (YES to 341, 345).

When the plurality of indoor units 200-1, 200-2, and 200-3 may be connected to a single branch duct 113-1 as illustrated in FIG. 4, even when the result of determination indicates that the first indoor unit 200-1 and the second indoor unit 200-2 are connected to the first indoor unit operation changer 110-1 as indicated in the rows T31 and T32 of FIG. 8, the air conditioner 1 may not determine that an error exists in the result of determination (NO to 341).

When a result of determination indicates that a single indoor unit, e.g., the third indoor unit 200-3, is connected to a plurality of indoor unit operation changers, e.g., the third indoor unit operation changer 110-3 and the fourth indoor unit operation changer 110-4, as indicated in rows T33 and T34 of FIG. 8, the air conditioner 1 may determine that an error exists in the result of determination (YES to 341) and that the state of the air conditioner 1 is abnormal (345).

When an error does not exist in the result of determination (NO to 341) and, accordingly, the state of the air conditioner 1 is determined as normal, the air conditioner 1 determines that the indoor units 200 (200-1, 200-2, 200-3, . . . , 200-N) are respectively connected to corresponding indoor unit operation changers 110 (110-1, 110-2, . . . , 110-N) according to the result of determination of Step 310 (343). Consequently, the indoor unit operation changers 110 (110-1, 110-2, . . . , 110-N) are controlled on the basis of the result of determination of Step 310, and in response to operations of the indoor unit operation changers 110 (110-1, 110-2, . . . , 110-N), the corresponding indoor units 200 (200-1, 200-2, 200-3, . . . , 200-N) properly perform the cooling operation or the heating operation.

When the state of the air conditioner 1 is abnormal, according to an embodiment, whether to review the result of determination on the connection state between each of the indoor unit operation changers 110 (110-1, 110-2, . . . , 110-N) and each of the indoor units 200 (200-1, 200-2, 200-3, . . . , 200-N) may be determined (347). When determined to review the result of determination (YES to 347), the above-described Steps 301, 310, 340, and 341 may be repeatedly performed.

When determined not to review the result of determination (NO to 347), a process of setting each of the indoor units 200 (200-1, 200-2, 200-3, . . . , 200-N) related to the indoor unit operation changers 110 (110-1, 110-2, . . . , 110-N) may be stopped. In this case, the result of determining the connection state between each of the indoor unit operation changers 110 (110-1, 110-2, . . . , 110-N) and each of the indoor units 200 (200-1, 200-2, 200-3, . . . , 200-N) may be deleted.

The above-described Steps 301, 310, 340, 341, 343, 345, and 347 may be performed by any one of the controller 101 of the control device 100 and the respective controllers 201 (201-1, 201-2, 201-3, . . . , 201-N) of the indoor units 200 (200-1, 200-2, 200-3, . . . , 200-N). For example, the determining of the connection state between each of the indoor unit operation changers 110 (110-1, 110-2, . . . , 110-N) and each of the indoor units 200 (200-1, 200-2, 200-3, . . . , 200-N) may be performed by the controllers 201-1, 201-2, 201-3, . . . , 201-N respectively disposed in the indoor units 200 (200-1, 200-2, 200-3, . . . , 200-N).

Hereinafter, a specific embodiment of a process of determining the connection state between each of the indoor unit operation changers 110 (110-1, 110-2, . . . , 110-N) and each of the indoor units 200 (200-1, 200-2, 200-3, . . . , 200-N) will be described.

Although a case in which there are four indoor unit operation changers 110 (110-1, 110-2, . . . , 110-N) and four indoor units 200 (200-1, 200-2, 200-3, . . . , 200-N) will be described below as an example for convenience of description, the process of determining the connection state between each of the indoor unit operation changers 110 (110-1, 110-2, . . . , 110-N) and each of the indoor units 200 (200-1, 200-2, 200-3, . . . , 200-N) is not limited thereto. The embodiment which will be described below may also be applied, without change or after some modifications, to a case in which the number of any of the indoor unit operation changers 110 (110-1, 110-2, . . . , 110-N) and the indoor units 200 (200-1, 200-2, 200-3, . . . , 200-N) is larger than four or less than four.

Figure 9:
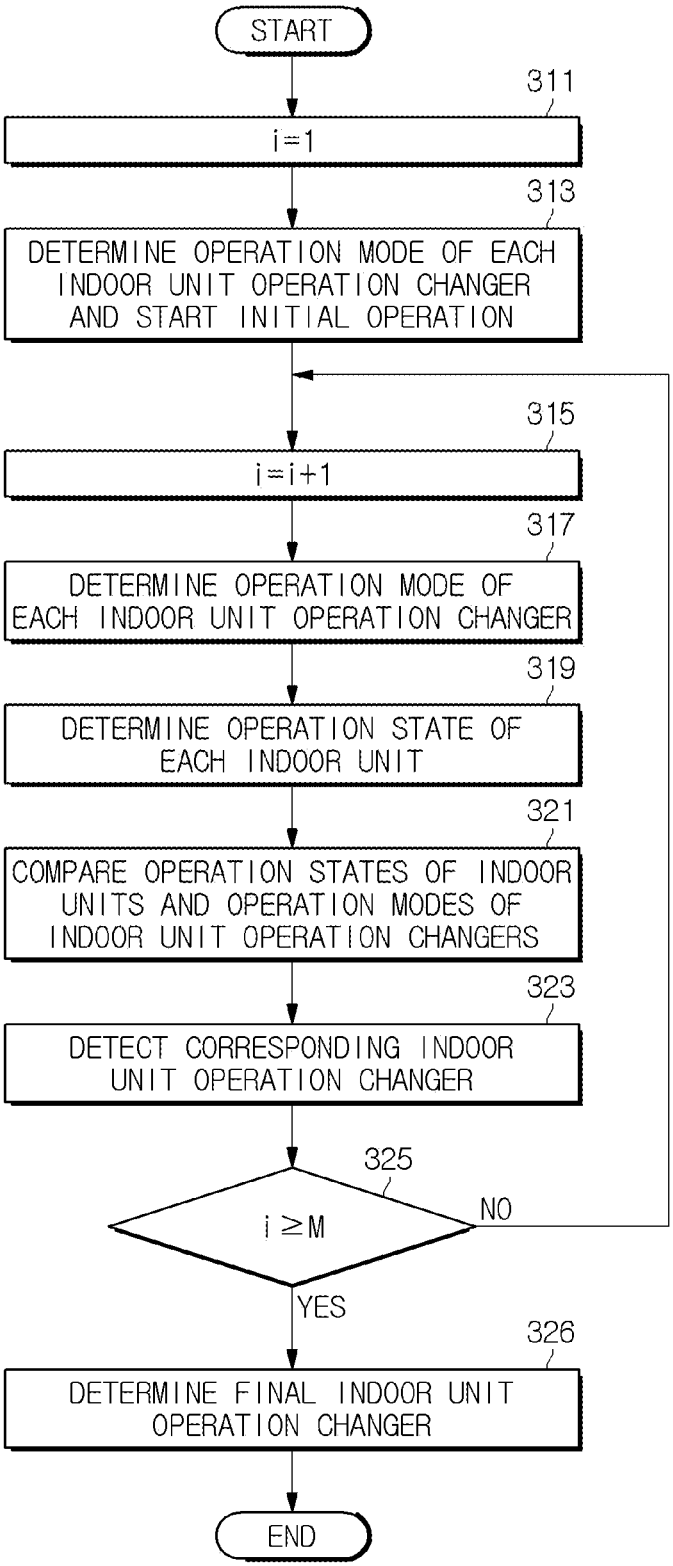
FIG. 9 is a flowchart of a process of determining an indoor unit connected to an indoor unit operation changer according to an embodiment.
Figure 11:
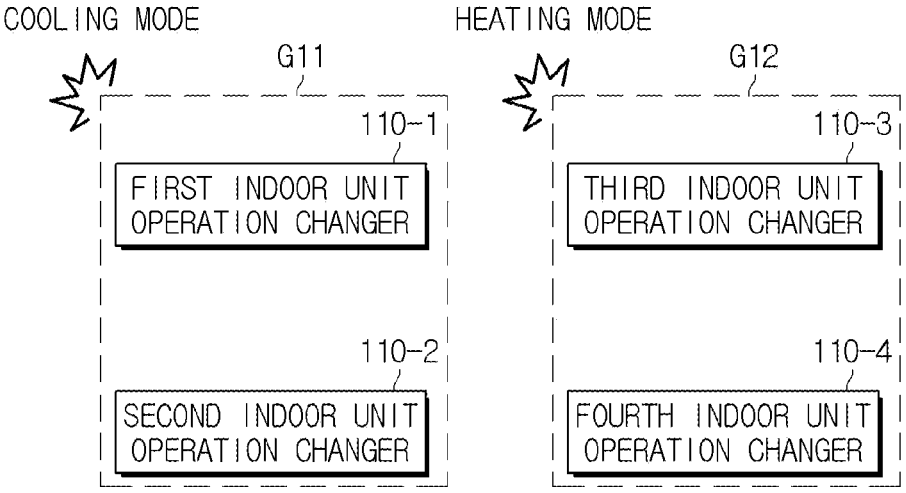
FIG. 11 is a view illustrating an example of grouping indoor unit operation changers in a first step.

FIG. 9 is a flowchart of a process of determining an indoor unit connected to an indoor unit operation changer according to an embodiment, and FIG. 10 is a view illustrating an example of settings of indoor unit operation changers according to each step. FIG. 11 is a view illustrating an example of grouping indoor unit operation changers in a first step.

When the air conditioner 1 starts an operation for determining the connection state between each of the indoor unit operation changers 110 (110-1, 110-2, . . . , 110-N) and each of the indoor units 200 (200-1, 200-2, 200-3, . . . , 200-N), as illustrated in FIGS. 9 and 10, the air conditioner 1 performs an operation of a first step T401 (311, 313).

Specifically, an operation of the first step T401 to be performed by the air conditioner 1 may be determined, and the air conditioner 1 may start an operation according to the determined operation. More specifically, in the first step T401, as illustrated in FIG. 9, operation modes of the indoor unit operation changers 110 (110-1, 110-2, . . . , 110-N) of the air conditioner 1 are determined, and the air conditioner 1 performs an initial operation according to the determined operation modes (313).

In the initial operation process, whether a refrigerant properly flows throughout the air conditioner 1 may be determined.

The operation modes of the indoor unit operation changers 110 (110-1, 110-2, . . . , 110-N) may be predetermined by a user or a designer or may be determined according to settings arbitrarily defined by the controller 101 of the control device 100 or the respective controllers 201-1, 201-2, 201-3, . . . , 201-N of the of the indoor units 200 (200-1, 200-2, 200-3, . . . , 200-N).

For example, as illustrated in FIGS. 10 and 11, in the first step T401, the first indoor unit operation changer 110-1 may be set to a cooling mode T411, the second indoor unit operation changer 110-2 may be set to a cooling mode T421, the third indoor unit operation changer 110-3 may be set to a heating mode T431, and the fourth indoor unit operation changer 110-4 may be set to a heating mode T441.

More specifically, the plurality of indoor unit operation changers 110-1, 110-2, 110-3, and 110-4 may be grouped into two groups G11 and G12 including a first group G11 operating at the cooling mode and a second group G12 operating at the heating mode.

For example, the first group G11 may be set to include at least two indoor unit operation changers, e.g., the first indoor unit operation changer 110-1 and the second indoor unit operation changer 110-2, and the second group G12 may be set to include at least two indoor unit operation changers, e.g., the third indoor unit operation changer 110-3 and the fourth indoor unit operation changer 110-4.

Information on the set operation mode of each of the indoor unit operation changers 110-1, 110-2, 110-3, and 110-4 or the two groups G11 and G12 may be stored in the predetermined storages 102, 203-1, 203-2, 203-3, and 203-4.

In this way, when operation modes of the first indoor unit operation changer 110-1, the second indoor unit operation changer 110-2, the third indoor unit operation changer 110-3, and the fourth indoor unit operation changer 110-4 are determined and set, and the first indoor unit operation changer 110-1, the second indoor unit operation changer 110-2, the third indoor unit operation changer 110-3, and the fourth indoor unit operation changer 110-4 may operate in accordance with the operation modes, the compressor 11 of the air conditioner compresses a refrigerant and discharges the compressed refrigerant. Accordingly, the refrigerant flows inside the air conditioner 1, and the initial operation is performed.

Depending on embodiments, the operations 311 and 313 of the air conditioner 1 according to the first step T401 may be omitted.

When the initial operation ends, the air conditioner 1 performs an operation according to a second step T402 (315).

Specifically, operation modes of the indoor unit operation changers 110 (110-1, 110-2, . . . , 110-N) corresponding to the second step T402 are determined (317).

More specifically, for example, as illustrated in FIGS. 10 and 11, in the second step T402, the first indoor unit operation changer 110-1 may be set to a cooling mode T412, the second indoor unit operation changer 110-2 may be set to a cooling mode T422, the third indoor unit operation changer 110-3 may be set to a heating mode T432, and the fourth indoor unit operation changer 110-4 may be set to a heating mode T442.

According to the embodiment, as illustrated in FIG. 10, the set modes of the first indoor unit operation changer 110-1, the second indoor unit operation changer 110-2, the third indoor unit operation changer 110-3, and the fourth indoor unit operation changer 110-4 in the second step T402 may be set to be respectively identical to those of the first indoor unit operation changer 110-1, the second indoor unit operation changer 110-2, the third indoor unit operation changer 110-3, and the fourth indoor unit operation changer 110-4 in the first step T401.

When the first indoor unit operation changer 110-1, the second indoor unit operation changer 110-2, the third indoor unit operation changer 110-3, and the fourth indoor unit operation changer 110-4 are set as described above, the compressor 11 of the air conditioner compresses a refrigerant and discharges the compressed refrigerant. Accordingly, the refrigerant flows inside the air conditioner 1, and the indoor units 200-1, 200-2, 200-3, and 200-4 perform the cooling operation or the heating operation in response to the transfer of the refrigerant.

After the indoor units 200-1, 200-2, 200-3, and 200-4 start operating, the operation states of the indoor units 200-1, 200-2, 200-3, and 200-4 are determined (319). For example, whether each of the indoor units 200-1, 200-2, 200-3, and 200-4 performs the cooling operation or the heating operation may be determined.

Whether each of the indoor units 200-1, 200-2, 200-3, and 200-4 performs the cooling operation or the heating operation may be determined using, for example, the indoor heat exchanger temperature measurers 205-1, 205-2, 205-3, and 205-4 respectively disposed in the indoor units 200-1, 200-2, 200-3, and 200-4.

Specifically, after temperatures of the indoor heat exchangers 210-1, 210-2, 210-3, and 210-4 are respectively measured by the indoor heat exchanger temperature measurers 205-1, 205-2, 205-3, and 205-4, the indoor units 200-1, 200-2, 200-3, and 200-4 may be determined as performing the heating operation when the measured temperatures exceed a predetermined value, and conversely, the indoor units 200-1, 200-2, 200-3, and 200-4 may be determined as performing the cooling operation when the measured temperatures do not exceed the predetermined value.

According to an embodiment, the predetermined value may be defined as temperature of an indoor space, i.e., indoor temperature. According to another embodiment, the predetermined value may be defined as a value obtained by adding the indoor temperature and a compensation value in consideration of an error between the indoor temperature and the temperatures of the indoor heat exchangers 210-1, 210-2, 210-3, and 210-4.

When the operation states of the indoor units 200-1, 200-2, 200-3, and 200-4 are determined, at least one of the controller 101 of the control device 100 and the respective controllers 201-1, 201-2, 201-3, and 201-4 of the indoor units 200-1, 200-2, 200-3, and 200-4 may compare the operation states of the indoor units 200-1, 200-2, 200-3, and 200-4 with the operation modes of the first indoor unit operation changer 110-1, the second indoor unit operation changer 110-2, the third indoor unit operation changer 110-3, and the fourth indoor unit operation changer 110-4 (321).

According to a result of comparison, among the plurality of indoor unit operation changers 110-1, 110-2, 110-3, and 110-4, one of the indoor unit operation changers 110-1, 110-2, 110-3, and 110-4 operating at a mode corresponding to an operation state of any one of the indoor units 200-1, 200-2, 200-3, and 200-4 is detected (323).

Figure 12:
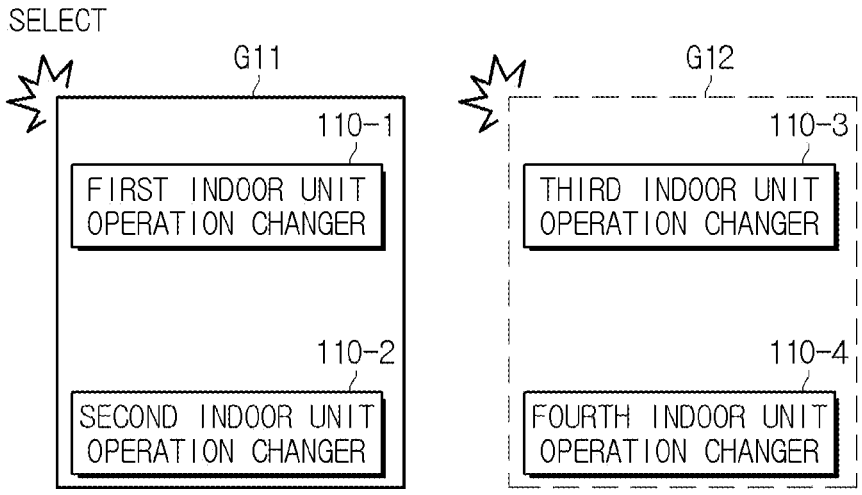
FIG. 12 is a view illustrating an example of selecting a group of indoor unit operation changers in the first step.

Specifically, when the first indoor unit 200-1 performs a cooling operation T511, as illustrated in FIG. 12, the controller 101 of the control device 100 or the respective controllers 201-1, 201-2, 201-3, and 201-4 of the indoor units 200-1, 200-2, 200-3, and 200-4 may detect the first group G11 set to the cooling mode among the plurality of groups G11 and G12 or erase the second group G12 set to the heating mode among the plurality of groups G11 and G12 from a predetermined candidate group. Here, the candidate group may be a group in which all of the plurality of indoor unit operation changers 110-1, 110-2, 110-3, and 110-4 are included.

As illustrated in FIG. 13, a result of detection or erasing may be stored in the predetermined storages 102, 203-1, 203-2, 203-3, and 203-4.

Accordingly, as a result of performing the second step T402, information T511 indicating that the first indoor unit 200-1 is performing the cooling operation and information T521 indicating that the first indoor unit operation changer 110-1 and the second indoor unit operation changer 110-2 are operating at the cooling mode are recorded.

The above comparing, determining, and recording may be identically performed in cases of other indoor units 200-2, 200-3, and 200-4.

Figure 14:
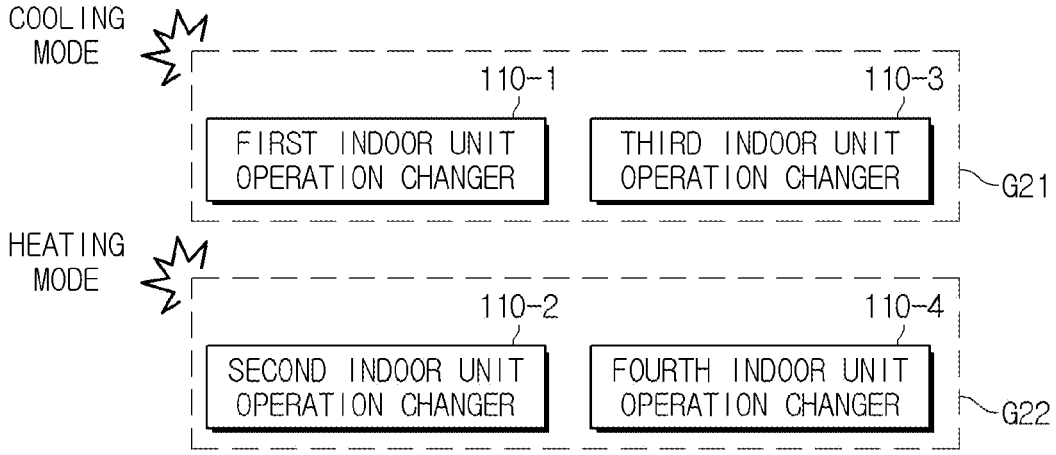
FIG. 14 is a view illustrating an example of grouping indoor unit operation changers in a second step.
Figure 15:
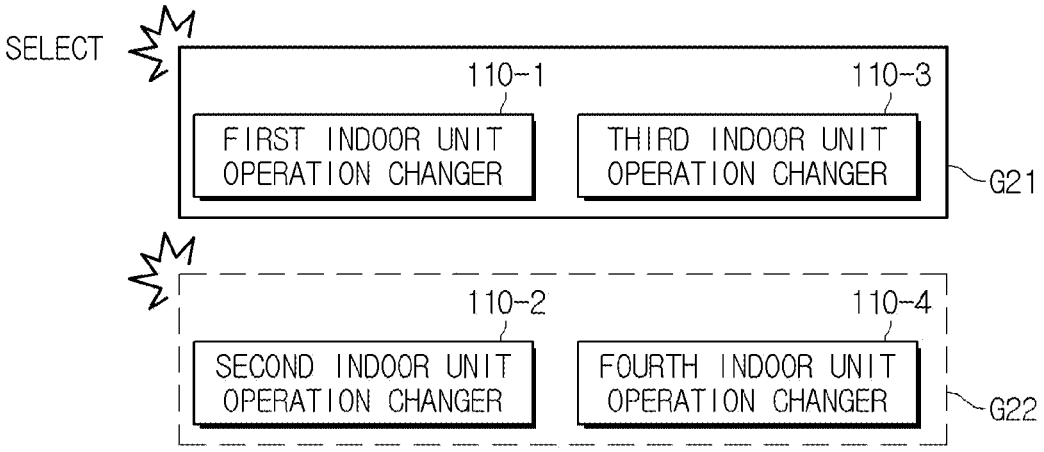
FIG. 15 is a view illustrating an example of selecting a group of indoor unit operation changers in the second step.

FIG. 14 is a view illustrating an example of grouping indoor unit operation changers in a second step, and FIG. 15 is a view illustrating an example of selecting a group of indoor unit operation changers in the second step.

When the operation of the second step T402 ends, and a step to be additionally performed is set (NO to 325), the following operation of a third step T403 is performed (325, 315).

According to an embodiment, whether a step to be additionally performed exists may be determined by a user, a designer, or the controllers 101, 201-1, 201-2, 201-3, and 201-4. For example, a total of M steps (M is an integer greater than 2) may be set to be performed by the user, the designer, or the controllers 101, 201-1, 201-2, 201-3, and 201-4.

The number M of the steps to be performed may be set to be smaller than the number of the indoor unit operation changers 110-1, 110-2, 110-3, and 110-4. For example, when the number of the indoor unit operation changers 110-1, 110-2, 110-3, and 110-4 is four, M may be defined as three. When the initial operation is omitted, M may be defined as two.

Specifically, as illustrated in FIG. 9, operation modes of the indoor unit operation changers 110 (110-1, 110-2, . . . , 110-N) corresponding to the third step T403 are determined (317).

For example, as illustrated in FIGS. 10 and 14, in the third step T403, the first indoor unit operation changer 110-1 may be set to a cooling mode T413, the second indoor unit operation changer 110-2 may be set to a heating mode T423, the third indoor unit operation changer 110-3 may be set to a cooling mode T433, and the fourth indoor unit operation changer 110-4 may be set to a heating mode T443.

Referring to FIG. 14, in the third step T403, the plurality of indoor unit operation changers 110-1, 110-2, 110-3, and 110-4 may be grouped differently from the second step T402. Specifically, in the third step T403, the plurality of indoor unit operation changers 110-1, 110-2, 110-3, and 110-4 may be grouped into a third group G21 operating at the cooling mode and a fourth group G22 operating at the heating mode, wherein the third group G21 is grouped differently from the first group G11, and the fourth group G22 is grouped differently from the second group G12.

For example, the third group G21 may be grouped to include at least two indoor unit operation changers, e.g., the first indoor unit operation changer 110-1 and the third indoor unit operation changer 110-3, and the fourth group G22 may be grouped to include at least two indoor unit operation changers, e.g., the second indoor unit operation changer 110-2 and the fourth indoor unit operation changer 110-4.

Same as the above description, information on the operation mode of each of the indoor unit operation changers 110-1, 110-2, 110-3, and 110-4 or the two groups G21 and G22 may be stored in the predetermined storages 102, 203-1, 203-2, 203-3, and 203-4.

When the operation mode of each of the first indoor unit operation changer 110-1, the second indoor unit operation changer 110-2, the third indoor unit operation changer 110-3, and the fourth indoor unit operation changer 110-4 is set, the compressor 11 of the air conditioner compresses a refrigerant and discharges the compressed refrigerant. Accordingly, each of the indoor units 200 (200-1, 200-2, 200-3, and 200-4) performs the cooling operation or the heating operation in response to the transfer of the refrigerant.

Same as the above description, after the indoor units 200-1, 200-2, 200-3, and 200-4 start operating, the operation states of the indoor units 200-1, 200-2, 200-3, and 200-4 are determined (319).

When the operation states of the indoor units 200-1, 200-2, 200-3, and 200-4 are determined, at least one of the controller 101 of the control device 100 and the respective controllers 201-1, 201-2, 201-3, and 201-4 of the indoor units 200-1, 200-2, 200-3, and 200-4 may compare the operation states of the indoor units 200-1, 200-2, 200-3, and 200-4 with the operation modes of the first indoor unit operation changer 110-1, the second indoor unit operation changer 110-2, the third indoor unit operation changer 110-3, and the fourth indoor unit operation changer 110-4 (321). According to a result of comparison, among the plurality of indoor unit operation changers 110-1, 110-2, 110-3, and 110-4, one of the indoor unit operation changers 110-1, 110-2, 110-3, and 110-4 operating at a mode corresponding to an operation state of any one of the indoor units 200-1, 200-2, 200-3, and 200-4 may be detected (323).

More specifically, for example, when the first indoor unit 200-1 is determined as performing a cooling operation T512, as illustrated in FIG. 15, the controller 101 of the control device 100 or the respective controllers 201-1, 201-2, 201-3, and 201-4 of the indoor units 200-1, 200-2, 200-3, and 200-4 may detect the third group G21 set to the cooling mode among the plurality of groups G21 and G22 or erase the fourth group G22 set to the heating mode among the plurality of groups G21 and G22 from a candidate group.

As illustrated in FIG. 13, a result of detection or erasing may be stored in the predetermined storages 102, 203-1, 203-2, 203-3, and 203-4.

The above comparing, determining, and recording may be identically performed in cases of other indoor units 200-2, 200-3, and 200-4.

When there are no more steps to be additionally performed (YES to 325), the controller 101 of the control device 100 or the respective controllers 201-1, 201-2, 201-3, and 201-4 of the indoor units 200-1, 200-2, 200-3, and 200-4 may determine the indoor unit operation changers 110-1, 110-2, 110-3, and 110-4 corresponding to the predetermined indoor units 200-1, 200-2, 200-3, and 200-4 on the basis of the result of detection or erasing illustrated in FIG. 13 (326).

When using the result of detection, the controllers 101, 201-1, 201-2, 201-3, and 201-4 may compare the indoor unit operation changers 110-1, 110-2, 110-3, and 110-4 detected in Steps T502 and T503 and determine the indoor unit operation changer 110 corresponding to the first indoor unit 200-1.

For example, as illustrated in FIG. 13, when the first indoor unit operation changer 110-1 and the second indoor unit operation changer 110-2 are detected with respect to the first indoor unit 200-1 in the second step T502, and the first indoor unit operation changer 110-1 and the third indoor unit operation changer 110-3 are detected with respect to the first indoor unit 200-1 in the third step T503, the controllers 101, 201-1, 201-2, 201-3, and 201-4 may detect an overlapping indoor unit operation changer, e.g., the first indoor unit operation changer 110-1, among the indoor unit operation changers 110-1 and 110-2 detected in the second step T502 and the indoor unit operation changers 110-1 and 110-3 detected in the third step T503 and determine the detected first indoor unit operation changer 110-1 as the indoor unit operation changer 110 corresponding to the first indoor unit 200-1.

When using the result of erasing, the controllers 101, 201-1, 201-2, 201-3, and 201-4 may determine a finally left indoor unit operation changer, e.g., the first indoor unit operation changer 110-1, as a result of performing Steps T502 and T503 as the indoor unit operation changer 110 corresponding to the first indoor unit 200-1.

The above-described process of acquiring the first indoor unit operation changer 110-1 corresponding to the first indoor unit 200-1 may be identically performed in cases of other indoor units 200-2, 200-3, and 200-4.

Accordingly, the indoor unit operation changers 110-1, 110-2, 110-3, and 110-4 respectively corresponding to the indoor units 200-1, 200-2, 200-3, and 200-4 may be acquired.

Hereinafter, a process of determining the indoor unit operation changer 110 corresponding to any one of the indoor units 200 in a case in which a total of 128 indoor units are connected to and installed at the control device 100 will be described in detail.

FIG. 16 is a view for describing a process of setting an operation of an indoor unit operation changer in each step when 128 indoor units are installed in a control device according to an embodiment, and FIG. 17 is a view for describing a process of setting an operation of an indoor unit operation changer in the first step.

Even when 128 indoor unit operation changers 110 are provided in the control device 100, and 128 indoor units 200 are respectively installed at the 128 indoor unit operation changers 110, as described with reference to FIG. 9, the air conditioner 1 may perform a plurality of steps to acquire the indoor unit operation changer 110 corresponding to each of the indoor units 200.

A first step T601 to a ninth step T609 which will be described below may be performed using a method in which the plurality of steps T401 and T402 described above with reference to FIGS. 9 to 15 are applied without change or after some modifications.

In the case in which 128 indoor units 200 are installed in the control device 100, an operation of the first step T601 is performed as an initial operation as described above.

Referring to FIGS. 16 and 17, in the first step T601, the indoor unit operation changers 110-1, 110-3, . . . , 110-127 whose identifiers are odd numbers are set to operate at the cooling mode, and the indoor unit operation changers 110-2, 110-4, . . . , 110-128 whose identifiers are even numbers are set to operate at the heating mode.

For example, referring to FIG. 17, the first indoor unit operation changer 110-1 whose identifier is 1, the third indoor unit operation changer 110-3 whose identifier is 3, a fifth indoor unit operation changer 110-5 whose identifier is 5, a seventh indoor unit operation changer 110-7 whose identifier is 7, a ninth indoor unit operation changer 110-9 whose identifier is 9, an eleventh indoor unit operation changer 110-11 whose identifier is 11, . . . , a sixty-third indoor unit operation changer 110-63 whose identifier is 63, a sixth-fifth indoor unit operation changer 110-65 whose identifier is 65, and so on may operate at the cooling mode.

Also, the second indoor unit operation changer 110-2 whose identifier is 2, the fourth indoor unit operation changer 110-4 whose identifier is 4, a sixth indoor unit operation changer 110-6 whose identifier is 6, an eighth indoor unit operation changer 110-8 whose identifier is 8, a tenth indoor unit operation changer 110-10 whose identifier is 10, a twelfth indoor unit operation changer 110-12 whose identifier is 12, . . . , a sixty-fourth indoor unit operation changer 110-64 whose identifier is 64, . . . , a hundred-twenty-eighth indoor unit operation changer 110-128 whose identifier is 128, and so on may operate at the heating mode.

Depending on embodiments, the first step T601 may be omitted.

FIG. 18 is a view for describing an example of an indoor unit operation changer selected for each indoor unit in a second step.

When the first step T601 ends, a second step T602 is performed.

The second step T602 may be performed with identical settings as the first step T601. In other words, even in the second step T602, the indoor unit operation changers 110-1, 110-3, . . . , 110-127 whose identifiers are odd numbers may be set to operate at the cooling mode, and the indoor unit operation changers 110-2, 110-4, . . . , 110-128 whose identifiers are even numbers may be set to operate at the heating mode.

Then, an operation state of each of the indoor units 200-1, 200-2, . . . , 200-128 is determined. For example, the operation of the first indoor unit 200-1 may be determined as the cooling operation, the operation of the second indoor unit 200-2 may be determined as the heating operation, an operation of a sixty-third indoor unit 200-63 may be determined as the cooling operation, an operation of a sixty-fourth indoor unit 200-64 may be determined as the heating operation, and an operation of a hundred-twenty-eighth indoor unit 200-128 may be determined as the heating operation.

The controllers 101, 201-1, 201-2, 201-3, and 201-4 may detect the indoor unit operation changers 110-1, 110-2, 110-3, . . . , 110-128 at the operation modes respectively corresponding to the operation states of the indoor units 200-1, 200-2, . . . , 200-128 among the plurality of indoor unit operation changers 110-1, 110-2, 110-3, . . . , 110-128. Alternatively, the controllers 101, 201-1, 201-2, 201-3, and 201-4 may erase the indoor unit operation changers 110-1, 110-2, 110-3, . . . , 110-128 at the operation modes not corresponding to the operation states of the indoor units 200-1, 200-2, . . . , 200-128 among the plurality of indoor unit operation changers 110-1, 110-2, 110-3, . . . , 110-128 from a candidate group.

For example, as illustrated in FIG. 18, in the case of the first indoor unit 200-1, indoor unit operation changers set to the cooling mode, e.g., the first indoor unit operation changer 110-1, the third indoor unit operation changer 110-3, and the like, may be selected. In the case of the second indoor unit 200-2, the indoor unit operation changers set to the heating mode, e.g., the second indoor unit operation changer 110-2, the fourth indoor unit operation changer 110-4, and the like may be selected. In the case of the sixty-third indoor unit 200-63, the indoor unit operation changers set to the cooling mode, e.g., the first indoor unit operation changer 110-1, the third indoor unit operation changer 110-3, and the like may be selected, and in the case of the sixty-fourth indoor unit 200-64, the indoor unit operation changers set to the heating mode, e.g., the second indoor unit operation changer 110-2, the fourth indoor unit operation changer 110-4, and the like, may be selected. In the case of the hundred-twenty-eighth indoor unit 200-128, the indoor unit operation changers set to the heating mode, e.g., the second indoor unit operation changer 110-2, the fourth indoor unit operation changer 110-4, and the like, may be selected.

When the second step T602 ends, a third step T603 is performed.

FIG. 19 is a view for describing a process of setting an operation of an indoor unit operation changer in a third step, and FIG. 20 is a view for describing an example of an indoor unit operation changer selected for each indoor unit in the third step.

A group of indoor unit operation changers operating at the cooling mode and a group of indoor unit operation changers operating at the heating mode in the third step T603 to an eighth step T608 are set differently from the group of indoor unit operation changers operating at the cooling mode and the group of indoor unit operation changers operating at the heating mode in the previous steps T602 to T607.

For example, in the third step T603 to the eighth step T608, each of the indoor unit operation changers 110-1, 110-2, 110-3, . . . , 110-128 operates according to a separator that is different from the identifier. The separator may be obtained by dividing the identifier by a predetermined value. In this case, the separator may be obtained by dividing the identifier by a predetermined value and getting rid of decimal points from a resulting value. For example, when the identifier is 3 and the predetermined value is 2, the separator may be a value obtained by dividing 3 by 2 and getting rid of decimal points from a resulting value. In other words, the separator may be 1.

In the third step T603, each of the indoor unit operation changers 110-1, 110-2, 110-3, . . . , 110-128 operates on the basis of the separator obtained by dividing the identifier by 2.

Referring to FIG. 19, separators of the first indoor unit operation changer 110-1 to the twelfth indoor unit operation changers 110-12 may be sequentially set as 0, 1, 1, 2, 2, 3, 3, 4, 4, 5, 5, and 6, respectively.

In this case, the indoor unit operation changers 110-2, 110-3, 110-6, 110-7, 110-10, 110-11, and the like whose separators are odd numbers are set to the cooling mode, and the indoor unit operation changers 110-1, 110-4, 110-5, 110-8, 110-9, 110-12, and the like whose separators are even numbers are set to the heating mode.

After the air conditioner 1 starts operating according to the settings, the operation state of each of the indoor units 200-1, 200-2, . . . , 200-128 is determined as described above. For example, as illustrated in FIG. 20, in the third step T603, the operation of the first indoor unit 200-1 may be determined as the heating operation, the operation of the second indoor unit 200-2 may be determined as the cooling operation, the operation of the sixty-third indoor unit 200-63 may be determined as the cooling operation, the operation of the sixty-fourth indoor unit 200-64 may be determined as the heating operation, and the operation of the hundred-twenty-eighth indoor unit 200-128 may be determined as the heating operation.

When the operation state of each of the indoor units 200-1, 200-2, . . . , 200-128 is determined, depending on embodiments, the indoor unit operation changers 110-1, 110-2, 110-3, . . . , 110-128 at operation modes respectively corresponding to the operation states of the indoor units 200-1, 200-2, . . . , 200-128 may be detected among the plurality of indoor unit operation changers 110-1, 110-2, 110-3, . . . , 110-128, or the indoor unit operation changers 110-1, 110-2, 110-3, . . . , 110-128 at operation modes not corresponding to the operation states of the indoor units 200-1, 200-2, . . . , 200-128 among the plurality of indoor unit operation changers 110-1, 110-2, 110-3, . . . , 110-128 may be erased from a candidate group.

For example, when the indoor unit operation changers 110-1, 110-2, 110-3, . . . , 110-128 at the operation modes not corresponding to the operation states of the indoor units 200-1, 200-2, . . . , 200-128 are erased from a candidate group related to the first indoor unit 200-1, as illustrated in FIG. 20, the indoor unit operation changers not corresponding to the heating operation of the first indoor unit 200-1 among the indoor unit operation changers 110-1, 110-3, 110-5, 110-7, and the like selected in the second step T602, i.e., the indoor unit operation changers 110-3, 110-7, and the like set to the cooling mode, are erased, and only the indoor unit operation changers corresponding to the heating operation of the first indoor unit 200-1, i.e., the indoor unit operation changers 110-1, 110-5, 110-9, and the like set to the heating mode, remain in the candidate group.

Even with respect to other indoor units 200-2 to 200-128, the indoor unit operation changers 110-1, 110-2, 110-3, . . . , 110-128 at operation modes respectively corresponding to the operation states of the indoor units 200-1, 200-2, . . . , 200-128 may be detected or the indoor unit operation changers 110-1, 110-2, 110-3, . . . , 110-128 at operation modes not corresponding to the operation states of the indoor units 200-1, 200-2, . . . , 200-128 may be erased from a candidate group through the same method as above.

FIG. 21 is a view for describing a process of setting an operation of an indoor unit operation changer in each of the plurality of steps according to an embodiment.

A fourth step T604 to the eighth step T608 may also be performed using a method in which the above-described second step T602 and third step T603 are applied without change or after some modifications.

Referring to FIG. 16, according to an embodiment, a separator may be a value obtained by dividing an identifier by 4 in the fourth step T604, a separator may be a value obtained by dividing an identifier by 8 in a fifth step T605, and a separator may be a value obtained by dividing an identifier by 16 in a sixth step T606. Also, a separator may be a value obtained by dividing an identifier by 32 in a seventh step T607, and a separator may be a value obtained by dividing an identifier by 64 in the eighth step T608.

As a result, as illustrated in FIG. 21, a separator corresponding to each of the indoor unit operation changers 110-1, 110-2, 110-3, . . . , 110-128 may be defined with an odd number or an even number in each of the fourth step T604 to the eighth step T608. For each of the steps T604 to T608, each of the indoor unit operation changers 110-1, 110-2, 110-3, . . . , 110-128 is set to the cooling mode or the heating mode according to whether the separator is an odd number or an even number.

For each of the steps T604 to T608, the operation state of each of the indoor units 200-1, 200-2, . . . , 200-128 is determined, and the determined operation state of each of the indoor units 200-1, 200-2, . . . , 200-128 is compared with the operation modes of the indoor unit operation changers 110-1, 110-2, 110-3, . . . , 110-128.

According to a result of comparison, the indoor unit operation changers 110-1, 110-2, 110-3, . . . , 110-128 related to the one or more indoor units 200-1 to 200-128 may be detected, or the indoor unit operation changers 110-1, 110-2, 110-3, . . . , 110-128 related to the one or more indoor units 200-1 to 200-128 may be erased from a candidate group.

In the ninth step T609, operation modes of the indoor unit operation changers 110-1, 110-2, 110-3, . . . , 110-128 are set oppositely from those in the first step T601 and the second step T602. In this case, opposite from that illustrated in FIG. 16, the indoor unit operation changers 110-1, 110-3, . . . , 110-127 whose identifiers are odd numbers may be set to operate at the heating mode, and the indoor unit operation changers 110-2, 110-4, . . . , 110-128 whose identifiers are even numbers may be set to operate at the cooling mode.

For example, the indoor unit operation changers 110-1, 110-3, . . . , 110-127 set to the cooling mode in the first step T601 and the second step T602 are set to the heating mode in the ninth step T609, and the indoor unit operation changers 110-2, 110-4, . . . , 110-128 set to the heating mode in the first step T601 and the second step T602 may be set to the cooling mode in the ninth step T609.

Even in the ninth step T609, as in the second step T602 to the eighth step T608, the operation state of each of the indoor units 200-1, 200-2, . . . , 200-128 is determined, and according to a result of comparison between the operation states of the indoor units 200-1, 200-2, . . . , 200-128 and the operation modes of the indoor unit operation changers 110-1, 110-2, 110-3, . . . , 110-128, the indoor unit operation changers 110-1, 110-2, 110-3, . . . , 110-128 related to the one or more indoor units 200-1 to 200-128 may be detected, or the indoor unit operation changers 110-1, 110-2, 110-3, . . . , 110-128 related to the one or more indoor units 200-1 to 200-128 may be erased from a candidate group.

FIG. 22 is a view for describing an example of an indoor unit operation changer selected for each indoor unit in each of the plurality of steps.

When the process of detecting the indoor unit operation changers 110-1, 110-2, 110-3, . . . , 110-128 is repeated or the process of erasing the indoor unit operation changers 110-1, 110-2, 110-3, . . . , 110-128 from a candidate group is repeated as described above, the indoor unit operation changers 110-1, 110-2, 110-3, . . . , 110-128 respectively corresponding to the indoor units 200-1, 200-2, . . . , 200-128 may be acquired.

For example, when the erasing process is repeated, as illustrated in FIG. 22, the indoor unit operation changers 110-1, 110-2, 110-3, . . . , 110-128 that does not correspond to the indoor units 200-1, 200-2, . . . , 200-128 are erased, and only the indoor unit operation changers 110-1, 110-2, 110-3, . . . , 110-128 respectively corresponding to the indoor units 200-1, 200-2, . . . , 200-128 are left in the candidate group.

The indoor unit operation changers 110-1, 110-2, 110-3, . . . , 110-128 left in the candidate group are determined as the indoor unit operation changers 110-1, 110-2, 110-3, . . . , 110-128 respectively corresponding to the indoor units 200-1, 200-2, . . . , 200-128, and the controllers 101, 201-1, 201-2, 201-3, and 201-4 store the determined indoor unit operation changers 110-1, 110-2, 110-3, . . . , 110-128 in the predetermined storages 102, 203-1, 203-2, 203-3, and 203-4.

Accordingly, the indoor unit operation changers 110-1, 110-2, 110-3, . . . , 110-128 respectively corresponding to the indoor units 2001-, 200-2, . . . , 200-128 may be determined.

The above-described process may be performed while simultaneously operating all of the indoor units 200-1, 200-2, . . . , 200-128, and accordingly, the process of determining the connection states between the indoor units 200-1, 200-2, . . . , 200-128 and the indoor unit operation changers 110-1, 110-2, 110-3, . . . , 110-128 may be more promptly performed.

FIG. 23 is a view for describing a process of setting an operation of an indoor unit operation changer in each step when 128 indoor units are installed in a control device according to another embodiment.

Although the example in which the indoor unit operation changers 110-1, 110-2, 110-3, . . . , 110-128 are set to operate at the cooling mode when identifiers or separators are odd numbers, and conversely, the indoor unit operation changers 110-1, 110-2, 110-3, . . . , 110-128 are set to operate at the heating mode when identifiers or separators are even numbers in the process of performing the first step T601 to the eighth step T608 is illustrated in FIG. 16, the indoor unit operation changers 110-1, 110-2, 110-3, . . . , 110-128 may be set oppositely from the above as illustrated in FIG. 23.

In other words, according to the other embodiment, as illustrated in FIG. 23, in the first step T601 to the eighth step T608, the indoor unit operation changers 110-1, 110-2, 110-3, . . . , 110-128 may be set to operate at the heating mode when identifiers or separators are odd numbers, and conversely, the indoor unit operation changers 110-1, 110-2, 110-3, . . . , 110-128 may be set to operate at the cooling mode when identifiers or separators are even numbers.

Opposite from that illustrated in FIG. 16, in the ninth step T609, the indoor unit operation changers 110-1, 110-2, 110-3, . . . , 110-128 are set to operate at the heating mode when identifiers are odd numbers, and the indoor unit operation changers 110-1, 110-2, 110-3, . . . , 110-128 are set to operate at the cooling mode when identifiers are even numbers. However, according to the other embodiment, the indoor unit operation changers 110-1, 110-2, 110-3, . . . , 110-128 may be set to operate at the heating mode when identifiers are even numbers, and the indoor unit operation changers 110-1, 110-2, 110-3, . . . , 110-128 may be set to operate at the cooling mode when identifiers are odd numbers in the ninth step T609.

Other than above, according to a designer's arbitrary selection, an operation mode when an identifier or a separator is an odd number and an operation mode when an identifier or a separator is an even number may be defined differently from other steps in two or more steps.

Figure 24:
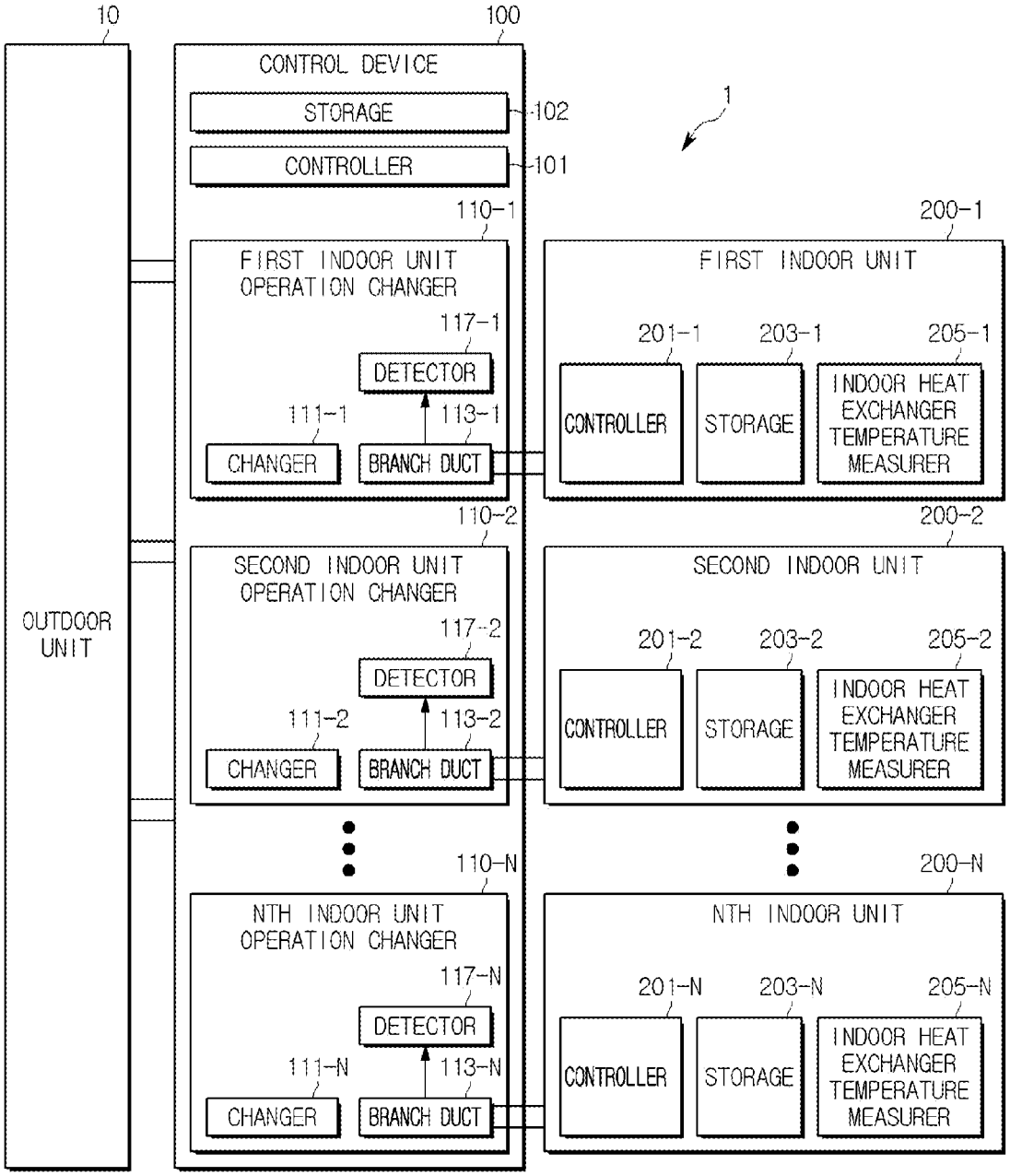
FIG. 24 is a block diagram of an air conditioner according to another embodiment.
Figure 25:
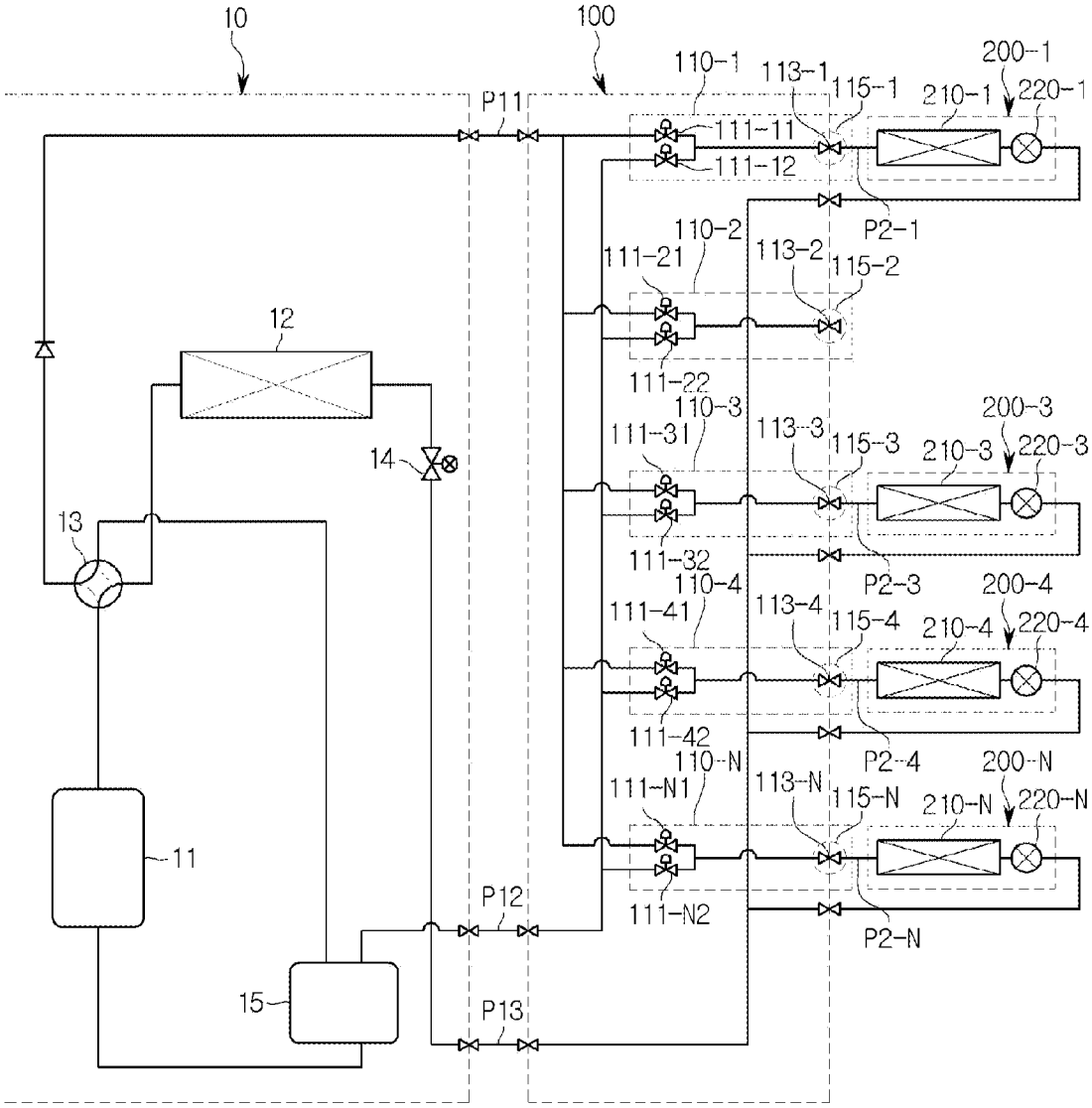
FIG. 25 is a view illustrating a state in which an indoor unit is not coupled to at least one branch duct of the air conditioner.

FIG. 24 is a block diagram of an air conditioner according to another embodiment, and FIG. 25 is a view illustrating a state in which an indoor unit is not coupled to at least one branch duct of the air conditioner.

Referring to FIG. 24, the air conditioner 1 may include the outdoor unit 10, the control device 100, and the plurality of indoor units 200-1, 200-2, . . . , 200-N.

The control device 100 may include the controller 101, the storage 102, and the plurality of indoor unit operation changers 110-1, 110-2, . . . , 110-N.

The plurality of indoor unit operation changers 110-1, 110-2, . . . , 110-N may respectively include the changers 111-1, 111-2, . . . , 111-N and the branch ducts 113-1, 113-2, . . . , 113-N and may further include detectors 117-1, 117-2, . . . , 117-N respectively connected to the branch ducts 113-1, 113-2, . . . , 113-N and configured to detect whether the branch ducts 113-1, 113-2, . . . , 113-N are connected to the indoor units 200-1, 200-2, . . . , 200-N.

The detectors 117-1, 117-2, . . . , 117-N may be disposed to respectively correspond to the branch ducts 113-1, 113-2, . . . , 113-N.

For example, as illustrated in FIG. 25, although some of the plurality of branch ducts 113-1, 113-2, 113-3, 113-4, . . . , 113-N, e.g., the first branch duct 113-1, the third branch duct 113-3, the fourth branch duct 113-4, and the $N^{th}$ branch duct 113-N respectively have the first indoor unit 200-1, the second indoor unit 200-2, the third indoor unit 200-3, and the $N^{th}$ indoor unit 200-N connected thereto via the pipes P2-1, P2-2, P2-3, P2-4, and P2-N, the remaining branch ducts, e.g., the second branch duct 113-2, may not have an indoor unit connected thereto.

The detectors 117-1, 117-2, . . . , 117-N may detect the branch ducts 113-1, 113-3, 113-4, . . . , 113-N to which the indoor units 200-1, 200-3, 200-4, and 200-N are connected as above or detect the branch duct 113-2 to which the indoor unit 200-2 is not connected, and according to a result of detection, electrical signals respectively corresponding to the detectors 117-1, 117-2, . . . , 117-N may be transmitted or not transmitted to the controllers 101, 201-1, 201-2, 201-3, and 201-4.

According to whether the electrical signals are received, the controllers 101, 201-1, 201-2, 201-3, and 201-4 may determine whether the indoor units 200-1, 200-2, . . . , 200-N are connected to the branch ducts 113-1, 113-2, 113-3, 113-4, . . . , 113-N.

According to an embodiment, the detectors 117-1, 117-2, . . . , 117-N may be designed to detect whether the pipes P2-1, P2-2, P2-3, P2-N are respectively installed at the branch ducts 113-1, 113-2, . . . , 113-N and transmit or not transmit an electrical signal corresponding to the result of detection to the controllers 101, 201-1, 201-2, 201-3, and 201-4.

In response to whether the electrical signal is received, the controllers 101, 201-1, 201-2, 201-3, and 201-4 may determine whether the pipes P2-1, P2-2, P2-3, P2-N are installed at the branch ducts 113-1, 113-2, . . . , 113-N. When whether the pipes P2-1, P2-2, P2-3, P2-N are installed at the branch ducts 113-1, 113-2, . . . , 113-N is determined, on the basis of the result of determination, the controllers 101, 201-1, 201-2, 201-3, and 201-4 may determine whether the indoor units 200-1, 200-2, . . . , 200-N are respectively connected to particular branch ducts 113-1, 113-2, . . . , 113-N.

According to an embodiment, each of the detectors 117-1, 117-2, . . . , 117-N may output a different electrical signal and transmit the output electrical signal to the controllers 101, 201-1, 201-2, 201-3, and 201-4. Accordingly, the controllers 101, 201-1, 201-2, 201-3, and 201-4 may determine from which of the plurality of detectors 117-1, 117-2, . . . , 117-N an electrical signal is output, and in response to the result of determination, determine to which of the branch ducts 113-1, 113-2, . . . , 113-N the indoor units 200-1, 200-2, . . . , 200-N are connected.

The detectors 117-1, 117-2, . . . , 117-N may be implemented using at least one of various devices capable of detecting whether the pipes P2-1, P2-2, P2-3, P2-N are connected to the branch ducts 113-1, 113-2, . . . , 113-N.

For example, the detectors 117-1, 117-2, . . . , 117-N may be implemented using switches disposed at the branch ducts 113-1, 113-2, . . . , 113-N and lead wires connected to the switches. When the pipes P2-1, P2-2, P2-3, P2-N are fastened to the branch ducts 113-1, 113-2, . . . , 113-N, according to the fastening of the pipes P2-1, P2-2, P2-3, P2-N, the switches are turned on, and accordingly, currents may flow in the lead wires connected to the switches. The currents flowing through the lead wires may be transmitted to the controllers 101, 201-1, 201-2, 201-3, and 201-4, and the controllers 101, 201-1, 201-2, 201-3, and 201-4 may determine whether the pipes P2-1, P2-2, P2-3, P2-N are connected to the branch ducts 113-1, 113-2, . . . , 113-N on the basis of the currents transmitted thereto.

The detectors 117-1, 117-2, . . . , 117-N may also be implemented using optical sensors or decompression sensors.

Other than above, the detectors 117-1, 117-2, . . . , 117-N may be implemented using at least one of various types of sensors that may be generally taken into consideration by a designer.

Because the outdoor unit 10, the plurality of indoor units 200-1, 200-2, . . . , 200-N, the controller 101 of the control device 100, the storage 102, and the respective changers 111-1, 111-2, . . . , 111-3 and the branch ducts 113-1, 113-2, . . . , 113-N of the indoor unit operation changers 110-1, 110-2, . . . , 110-N have been described above, detailed descriptions thereof will be omitted.

Figure 26:
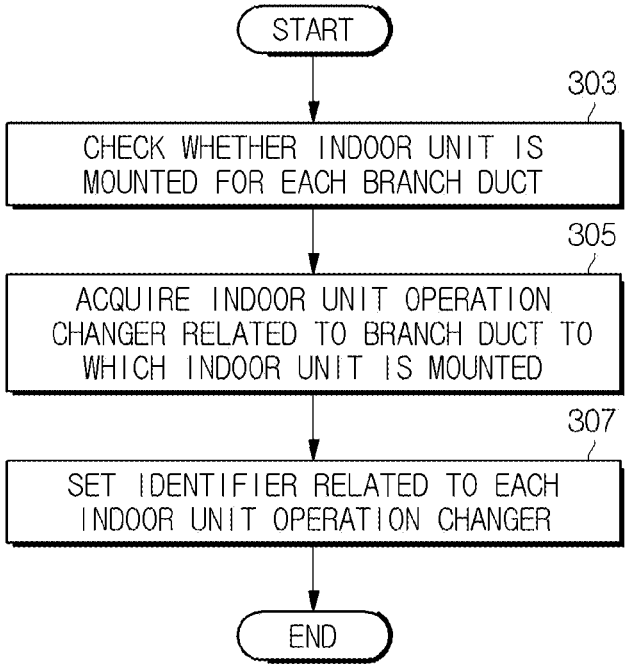
FIG. 26 is a flowchart for describing a process of setting an identifier for an indoor unit operation changer according to another embodiment.

FIG. 26 is a flowchart for describing a process of setting an identifier for an indoor unit operation changer according to another embodiment.

As described above, some of the plurality of branch ducts 113-1, 113-2, 113-3, 113-4, and 113-N, e.g., the second branch duct 113-2, may not have an indoor unit connected thereto.

In this case, the air conditioner 1 may remove the branch duct 113-2 at which the indoor units 200-1, 200-3, 200-4, and 200-N are not mounted from objects of determination.

Specifically, referring to FIG. 26, whether the indoor units 200-1, 200-2, . . . , 200-N are mounted is determined for each of the branch ducts 113-1, 113-2, . . . , 113-N (303). As described above, this may be performed by the controllers 101, 201-1, 201-2, 201-3, and 201-4 on the basis of the result of determination of the detectors 117-1, 117-2, . . . , 117-N.

The controllers 101, 201-1, 201-2, 201-3, and 201-4 detect only the one or more branch ducts 113-1, 113-3, 113-4, . . . , 113-N at which the indoor units 200-1, . . . , 200-N are mounted among the plurality of branch ducts 113-1, 113-2, . . . , 113-N, and detect and acquire the indoor unit operation changers 110-1, 110-3, 110-4, . . . , 110-N respectively corresponding to the one or more branch ducts 113-1, 113-3, 113-4, . . . , 113-N (305). In other words, the controllers 101, 201-1, 201-2, 201-3, and 201-4 may acquire the indoor unit operation changers 110-1, 110-3, 110-4, . . . , 110-N connected to the indoor units 200-1, . . . , 200-N.

Then, the controllers 101, 201-1, 201-2, 201-3, and 201-4 set identifiers of the detected indoor unit operation changers 110-1, 110-3, 110-4, . . . , 110-N (307).

According to an embodiment, the above-described process (303 to 307) of removing the branch duct 113-2 at which the indoor units 200-1, 200-3, 200-4, and 200-N are not mounted from objects of determination may be performed instead of the setting of the identifiers of the indoor unit operation changers (301) of FIG. 5.

As a result, the controllers 101, 201-1, 201-2, 201-3, and 201-4 may determine connection states with the indoor units 200-1, 200-3, 200-4, and 200-N only with respect to the indoor unit operation changers 110-1, 110-3, 110-4, . . . , 110-N connected to the indoor units 200-1, 200-3, 200-4, and 200-N. Consequently, an unnecessary determination process related to the branch duct 113-2 to which the indoor unit is not connected may be omitted, and accordingly, the connection states between the indoor unit operation changers 110-1, 110-3, 110-4, . . . , 110-N and the indoor units 200-1, 200-3, 200-4, and 200-N may be determined.

FIG. 27 is a view for describing a process of setting an operation of an indoor unit operation changer in each step according to another embodiment, and FIG. 28 is a view for describing a process of setting an operation of an indoor unit operation changer in each of the plurality of steps according to another embodiment.

The process, in which the indoor unit operation changers 110-1, 110-2, 110-3, 110-4, . . . , 110-N are set to any one of two modes (that is, the cooling mode or the heating mode), the indoor units 200-1, 200-2, 200-3, 200-4, and 200-N are operated using any one of two operations (that is, the cooling operation or the heating operation), and the connection states between the indoor unit operation changers 110-1, 110-2, 110-3, 110-4, . . . , 110-N and the indoor units 200-1, 200-2, 200-3, 200-4, and 200-N are determined, has been described with reference to FIGS. 5 to 26.

According to another embodiment, the indoor unit operation changers 110-1, 110-2, 110-3, 110-4, . . . , 110-N may be set to three modes.

For example, as illustrated in FIG. 27, the indoor unit operation changers 110-1, 110-2, 110-3, 110-4, . . . , 110-N may be set to any one of a cooling mode, a heating mode, and a break mode.

The heating mode may be set by the first valve 111-11 among the two valves 111-11 and 111-12 of the indoor unit operation changers 110-1, 110-2, 110-3, 110-4, . . . , 110-N opening a flow path and the second valve 111-12 closing the flow path. The cooling mode may be set by the second valve 111-12 among the two valves 111-11 and 111-12 of the indoor unit operation changers 110-1, 110-2, 110-3, 110-4, . . . , 110-N opening a flow path and the first valve 111-11 closing the flow path.

The break mode may be set by both of the two valves 111-11 and 111-12 of the indoor unit operation changers 110-1, 110-2, 110-3, 110-4, . . . , 110-N closing a flow path.

For example, as illustrated in FIG. 27, in each of the steps, the indoor unit operation changers 110-1, 110-2, 110-3, 110-4, . . . , 110-N may be set to the cooling mode when an identifier or a separator is 3k+1 (k=0, 1, 2, 3, . . . ), set to the heating mode when an identifier is 3k+2 (k=0, 1, 2, 3, . . . ), and set to the break mode when an identifier is 3k (k=0, 1, 2, 3, . . . ). Here, the separator may be obtained by dividing the identifier by 3.

The operation modes of the indoor unit operation changers 110-1, 110-2, 110-3, 110-4, . . . , 110-N may be defined differently from those indicated in FIG. 27 according to a designer's selection. For example, the indoor unit operation changers 110-1, 110-2, 110-3, 110-4, . . . , 110-N may be set to the cooling mode when the identifier or the separator is 3k (k=0, 1, 2, 3, . . . ), set to the heating mode when the identifier is 3k+1 (k=0, 1, 2, 3, . . . ), and set to the break mode when the identifier is 3k+2 (k=0, 1, 2, 3, . . . ).

In this case, in the first step and the second step, the operation modes of the indoor unit operation changers 110-1, 110-2, 110-3, 110-4, . . . , 110-N may be set identically. In the third step, the operation modes of the indoor unit operation changers 110-1, 110-2, 110-3, 110-4, . . . , 110-N may be set using the separator obtained by dividing the identifier by 3.

As described above, the first step is set as an initial operation, and information for determining the connection states between the indoor unit operation changers 110-1,

110-2, 110-3, 110-4, . . . , 110-N and the indoor units 200-1, 200-2, 200-3, 200-4, . . . , 200-N is acquired in the second step and the third step.

When there are nine indoor unit operation changers 110-1, . . . , 110-9 as illustrated in FIG. 28, as described above, for each of the first step T401 to the third step T403, each of the indoor unit operation changers 110-1, 110-2, 110-3, 110-4, . . . , 110-N is set to any one of the cooling mode, the heating mode, and the break mode according to a predetermined setting, operation states of the indoor units 200-1, 200-2, 200-3, 200-4, . . . , 200-N are determined, and the set modes of the indoor unit operation changers 110-1, 110-2, 110-3, 110-4, . . . , 110-N are compared with the operation states of the indoor units 200-1, 200-2, 200-3, 200-4, . . . , 200-N.

Accordingly, the connection relations between the indoor unit operation changers 110-1, 110-2, 110-3, 110-4, . . . , 110-N and the indoor units 200-1, 200-2, 200-3, 200-4, . . . , 200-N may be determined.

The method of controlling an air conditioner according to the above-described embodiments may be implemented in the form of a program that may be executed by various computer devices. Here, the program may include a program command, a data file, a data structure, and the like solely or in combination. The program may be designed and produced using machine language codes or high-level language codes. The program may be particularly designed to implement the above-described method of controlling an air conditioner or may be implemented using various functions or definitions that are known and usable by one of ordinary skill in the computer software art.

The program for implementing the method of controlling an air conditioner may be recorded in a computer readable recording medium. For example, the computer readable recording medium may include various types of hardware devices capable of storing particular programs executed according to call from a computer and the like such as magnetic disk storage media such as a hard disk and a floppy disk, a magnetic tape, optical media such as a compact disk (CD) or a digital versatile disk (DVD), magneto-optical media such as a floptical disk, and semiconductor storage devices such as a ROM, a RAM, or a flash memory.

As is apparent from the above description, according to the above-described air conditioner, a control device thereof, and a method of controlling the same, how each of a plurality of indoor units is connected to the control device can be promptly and accurately determined automatically.

According to the above-described air conditioner, a control device thereof, and a method of controlling the same, indoor units can be simultaneously operated to determine how each of the indoor units is connected to the control device, and accordingly, how each of the indoor units is connected to the control device can be more promptly determined in comparison to a case in which the indoor units are sequentially operated.

According to the above-described air conditioner, a control device thereof, and a method of controlling the same, how each of indoor units is connected to the control device can be determined even without information on connection states between the indoor units and the control device being separately input by a user, and accordingly, user convenience can be improved.

According to the above-described air conditioner, a control device thereof, and a method of controlling the same, how each of indoor units is connected to the control device can be determined with the least number of steps, and thus operational efficiency can be improved.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An air conditioner comprising:

a control device including a plurality of indoor unit operation changers configured to be set to an operation mode of any one of a cooling mode or a heating mode; and a plurality of indoor units, each of the plurality of indoor units is connected to any one of the plurality of indoor unit operation changers and configured to perform an operation of any operation state of a cooling operation or a heating operation according to a result of setting the plurality of indoor unit operation changers, the cooling mode corresponding to the cooling operation and the heating mode corresponding to the heating operation, wherein the control device is configured to set the plurality of indoor unit operation changers to operate according to a predetermined operation mode for each of the plurality of indoor unit operation changers, for M times operations, wherein M is smaller than a number of the plurality of indoor unit operation changers, wherein, for each indoor unit of the plurality of indoor units, at least one of the indoor unit and the control device is configured to:

determine an operation state of the indoor unit, for each of the M times operations, and detect at least one indoor unit operation changer, which was set to the operation mode corresponding to the operation state of the indoor unit, among the plurality of indoor unit operation changers, for each of the M times operations, and determine an indoor unit operation changer which is connected to the indoor unit, based on the at least one indoor unit operation changer which was set to the operation mode corresponding to the operation state of the indoor unit in the M times operations.

2. The air conditioner of claim 1, wherein the at least one of the indoor unit and the control device is further configured to:

detect an indoor unit operation changer among the plurality of indoor unit operation changers which was set to the cooling mode when the indoor unit performs the cooling operation; and detect an indoor unit operation changer among the plurality of indoor unit operation changers which was set to the heating mode when the indoor unit performs the heating operation.

3. The air conditioner of claim 1, wherein the at least one of the indoor unit and the control device is further configured to select a first cooling mode indoor unit operation changer and a first heating mode indoor unit operation changer among the plurality of indoor unit operation changers.

4. The air conditioner of claim 3, wherein the at least one of the indoor unit and the control device is further configured to:

detect the first cooling mode indoor unit operation changer among the plurality of indoor unit operation changers when the indoor unit performs the cooling operation, and detect the first heating mode indoor unit operation changer among the plurality of indoor unit operation changers when the indoor unit performs the heating operation.

5. The air conditioner of claim 4, wherein the at least one of the indoor unit and the control device is further configured to select, among the plurality of indoor unit operation changers, a second cooling mode indoor unit operation changer and a second heating mode indoor unit operation changer that are different from the first cooling mode indoor unit operation changer and the first heating mode indoor unit operation changer, respectively.

6. The air conditioner of claim 5, wherein the at least one of the indoor unit and the control device is further configured to:

detect the second cooling mode indoor unit operation changer when the indoor unit performs the cooling operation;

detect the second heating mode indoor unit operation changer when the indoor unit performs the heating operation; and determine an indoor unit operation changer among the plurality of indoor unit operation changers which is connected to the indoor unit based on the first heating mode indoor unit operation changer, the first cooling mode indoor unit operation changer, the second heating mode indoor unit operation changer and the second cooling mode indoor unit operation changer.

7. A control device comprising:

a plurality of branch ducts;

a plurality of changers configured to change an operation state of at least one indoor unit connected to at least one of the plurality of branch ducts to any one of a cooling operation and a heating operation; and a controller configured to set the plurality of changers to operate according to a predetermined operation mode for each of the plurality of changers, for M times operations, wherein M is smaller than a number of the plurality of changers, wherein, for each of a plurality of indoor units, the controller is further configured to:

determine an operation state of the indoor unit, for each of the M times operations determine an operation mode for each of the plurality of changers, for each of the M times operations, wherein the operation mode is any one of a cooling mode or a heating mode, detect one or more first changers among the plurality of changers which was set to the cooling mode when the indoor unit performs the cooling operation, for each of the M times operations, detect one or more second changers among the plurality of changers which was set to the heating mode when the indoor unit performs the heating operation, for each of the M times operations, and determine a changer which is connected to the indoor unit based on at least one indoor unit operation changer that was set to the operation mode corresponding to the operation state of the indoor unit in the M times operations.

8. A method of controlling an air conditioner, the method comprising:

setting a plurality of indoor unit operation changers to operate according to a predetermined operation mode for each of the plurality of indoor unit operation changers, for M times operations, wherein M is smaller than a number of the plurality of indoor unit operation changers, wherein the operation mode is any one of a cooling mode or a heating mode; and determining an indoor unit operation changer that is connected to an indoor unit, for each of a plurality of indoor units;

wherein the determining comprises:

determining an operation state of the indoor unit, for each of the M times operations, wherein the operation state is any one of a cooling operation or a heating operation, and detecting at least one indoor unit operation changer, which was set to the operation mode corresponding to the operation state of the indoor unit, among the plurality of indoor unit operation changers, for each of the M times operations; and determining the indoor unit operation changer which is connected to the indoor unit, based on the at least one indoor unit operation changer that was set to the operation mode corresponding to the operation state of the indoor unit in the M times operations.

9. The method of claim 8, wherein the detecting the at least one indoor unit operation changer among the plurality of indoor unit operation changers corresponds to the operation state of the indoor unit includes at least one of:

detecting an indoor unit operation changer among the plurality of indoor unit operation changers which was set to the cooling mode when the indoor unit performs the cooling operation; and detecting an indoor unit operation changer among the plurality of indoor unit operation changers which was set to the heating mode when the indoor unit performs the heating operation.

10. The method of claim 8, wherein the detecting an indoor unit operation changer among the plurality of indoor unit operation changers includes:

selecting a first cooling mode indoor unit operation changer among the plurality of indoor unit operation changers to be set to the cooling mode;

detecting the first cooling mode indoor unit operation changer when the indoor unit performs the cooling operation; and detecting a first heating mode indoor unit operation changer among the plurality of indoor unit operation changers other than the first cooling mode indoor unit operation changer when the indoor unit performs the heating operation.

11. The method of claim 10, wherein the detecting an indoor unit operation changer among the plurality of indoor unit operation changers further includes:

selecting, among the plurality of indoor unit operation changers, a second cooling mode indoor unit operation changer among the plurality of indoor unit operation changers different from first cooling mode indoor unit operation changer to be set to the cooling mode;

detecting the second cooling mode indoor unit operation changer when the indoor unit performs the cooling operation;

detecting a second heating mode indoor unit operation changer among the plurality of indoor unit operation changers other than the second cooling mode indoor unit operation changer when the indoor unit performs the heating operation; and determining an indoor unit operation changer among the plurality of indoor unit operation changers which is connected to the indoor unit based on the first heating mode indoor unit operation changer, the first cooling mode indoor unit operation changer, the second heating mode indoor unit operation changer, and the second cooling mode indoor unit operation changer.

* * * * *